US006132035A

United States Patent [19]

Kutami et al.

[11] Patent Number: 6,132,035

[45] **Date of Patent: *Oct. 17, 2000**

[54] PRINTING HEAD HAVING RESILIENTLY SUPPORTED VIBRATION PLATE

[75] Inventors: Michinori Kutami, Kawaguchi; Akira Nakazawa, Isehara; Hideyuki Kikuchi, Zama; Katsunori Yamagishi, Atsugi, all of Japan

[73] Assignee: Fujitsu Limited, Kawasaki, Japan

[ * ] Notice: This patent is subject to a terminal disclaimer.

[21] Appl. No.: 08/230,741

[22] Filed: Apr. 21, 1994

Related U.S. Application Data

[62] Division of application No. 07/838,401, Mar. 10, 1992, abandoned.

[30] Foreign Application Priority Data

| | | | |
|---|---|---|---|
| Jul. 10, 1990 | [JP] | Japan | 2-180380 |
| Dec. 20, 1990 | [JP] | Japan | 2-404414 |
| May 16, 1991 | [JP] | Japan | 3-111263 |
| May 23, 1991 | [JP] | Japan | 3-117786 |
| May 31, 1991 | [JP] | Japan | 3-128115 |

[51] Int. Cl.[7] ..... B41J 2/045

[52] U.S. Cl. ..... 347/70; 347/54

[58] Field of Search ..... 347/54, 70, 68, 347/71; 400/124.1

[56] References Cited

U.S. PATENT DOCUMENTS

| | | | |
|---|---|---|---|
| 3,900,162 | 8/1975 | Titus | 347/75 X |
| 4,184,169 | 1/1980 | Taylor | 347/48 X |
| 4,272,200 | 6/1981 | Hehl | 347/68 X |
| 4,331,964 | 5/1982 | VanLokeren | 347/75 |
| 4,375,066 | 2/1983 | Herd | 347/68 |
| 4,383,264 | 5/1983 | Lewis | 347/70 |
| 4,418,355 | 11/1983 | DeYoung | 347/70 X |
| 4,516,140 | 5/1985 | Durkee | 347/71 |
| 4,544,932 | 10/1985 | Barnett | 347/68 |
| 4,559,544 | 12/1985 | Matsumoto et al. | 347/70 X |
| 4,591,883 | 5/1986 | Isayama | 347/70 |
| 4,723,131 | 2/1988 | Droit | 347/54 |
| 4,769,654 | 9/1988 | Tanaka | 347/40 |

FOREIGN PATENT DOCUMENTS

| | | | |
|---|---|---|---|
| 0083877 | 7/1983 | European Pat. Off. | B41J 3/04 |
| 2338089 | 8/1977 | France | B41J 3/04 |
| 3438033 | 4/1986 | Germany | B41J 3/04 |
| 53-134519 | 11/1978 | Japan | B41J 3/10 |
| 55-14293 | 1/1980 | Japan | B41J 1/30 |
| 55-53572 | 4/1980 | Japan | B41J 3/04 |
| 55-59978 | 5/1980 | Japan | B41J 3/04 |
| 56-11285 | 2/1981 | Japan | B41J 9/00 |

(List continued on next page.)

OTHER PUBLICATIONS

*Patent Abstracts of Japan*, vol. 6, No. 242 (M–175)(1120), Nov. 30, 1982 (JP 57–140172).

*Patent Abstracts of Japan*, vol. 10, No. 176 (M–491)(2232), Jun. 20, 1986 (JP 61–025851).

*Patent Abstracts of Japan*, vol. 9, No. 238 (M–416)(1961), Sep. 25, 1985 (JP 60–092864).

R.G. Cross, "Ribbonless Ink Printer", *IBM Technical Disclosure Bulletin*, vol. 16, No. 1, Jun. 3, 1973, p. 310.

*Primary Examiner*—Fred L. Braun

*Attorney, Agent, or Firm*—Staas & Halsey LLP

[57] ABSTRACT

An ink jet printing head includes a pressure chamber supplied with ink, a vibration plate, a nozzle, a force applying mechanism and a resilient member. The vibration plate is coupled to the pressure chamber and is subject to being driven in vibration to increase pressure in the pressure chamber when force is applied to the vibration plate. The nozzle communicates with the pressure chamber, and ink is ejected through the nozzle when pressure in the pressure chamber is increased. The force applying mechanism applies force to the vibration plate to drive the vibration plate in vibration and thereby increase the pressure in the pressure chamber to eject ink from the nozzle. The resilient member is interposed between the pressure chamber and the vibration plate. The resilient member resiliently supports the vibration plate relative to the pressure chamber.

16 Claims, 29 Drawing Sheets

FOREIGN PATENT DOCUMENTS

| | | | |
|---|---|---|---|
| 57-105360 | 6/1982 | Japan | B41J 3/04 |
| 57-140172 | 8/1982 | Japan | B41J 3/04 |
| 58-55253 | 4/1983 | Japan | B41J 3/04 |
| 59-26270 | 2/1984 | Japan | B41J 3/04 |
| 60-204340 | 10/1985 | Japan | B41J 3/04 |
| 60-239249 | 11/1985 | Japan | B41J 3/04 |
| 61-41554 | 2/1986 | Japan | B41J 3/04 |
| 61-37935 | 3/1986 | Japan | B41J 3/04 |
| 61-127358 | 6/1986 | Japan | B41J 3/04 |
| 61-287758 | 12/1986 | Japan | B41J 3/04 |
| 62-73952 | 4/1987 | Japan | B41J 3/04 |
| 62-87354 | 4/1987 | Japan | B41J 3/04 |
| 63-128949 | 6/1988 | Japan | B41J 3/04 |
| 63-199651 | 8/1988 | Japan | B41J 3/04 |
| 3-211059 | 9/1991 | Japan | B41J 2/225 |

PRINTING HEAD HAVING RESILIENTLY SUPPORTED VIBRATION PLATE

This application is a divisional of U.S. application Ser. No. 07/838,401, filed Mar. 10, 1992, now abandoned.

BACKGROUND OF THE INVENTION

1. Field of the Invention

The present invention generally relates to printing heads, and more particularly to an ink jet type printing head which is applied to image recording apparatuses such as printers and facsimile machines.

2. Description of the Related Art

The conventional ink jet type printing head is provided with a nozzle, a pressure chamber, an ink supply passage and an ink tank, and ink particles are ejected from the nozzle by generating pressure in the pressure chamber so that characters or images are recorded on a recording paper. As means of applying the pressure to the pressure chamber, the generally known system adheres a piezoelectric element on the outer wall of the pressure chamber and uses the displacement of the piezoelectric element which is generated by applying a pulse voltage to the piezoelectric element. FIG. 1 is a diagram for explaining the general structure of the conventional printing head using this system. In FIG. 1, an ink 2 fills a pressure chamber 1, and a piezoelectric element 3 is adhered on an outer wall 1*a* of the pressure chamber 1. One end of the pressure chamber 1 communicates with a nozzle 4, and the other end is connected to an ink tank which is not shown.

FIGS. 2A and 2B are diagrams for explaining the function of the printing head shown in FIG. 1. FIG. 2A shows a state where the voltage is applied to the piezoelectric element 3 and the ink is about to be ejected from the nozzle 4, and FIG. 2B shows a state where ink particles 5 (i.e., droplets) are ejected.

On the other hand, as shown in FIGS. 3A through 3E, there is a system of using a thermal resistor element 7 which is positioned in the vicinity of a nozzle 6 as the pressure generating means. In the printing head employing this system, a pulse voltage is applied to the thermal resistor element 7, and bubbles 8 are generated within the ink by the heat which is generated, so as to eject ink particles 9 from the nozzle by this pressure. FIG. 3A shows an initial state of the bubble generation, FIG. 3B shows a state where bubbles are generated to a certain extent, FIG. 3C shows a state where the bubble has grown large and the ejection of the ink is about to start, FIG. 3D shows a state where the ink ejection has progressed further, and FIG. 3E shows a state where the ink particles 9 have been injected.

The conventional ink jet type printing heads described above are suited for use in offices because they generate far less noise compared to the wire dot printing heads, i.e., dot matrix printers, which print by pressing wires against a platen via an ink ribbon and the paper.

However, the conventional ink jet type printing heads suffer from the following disadvantages.

That is, in the case shown in FIGS. 1, 2A and 2B, the entire printing head must be replaced because dust particles and the like adhere to the nozzle of the printing head, air bubbles enter from the nozzle, or the nozzle becomes blocked by dried ink.

In addition, even in the case shown in FIGS. 3A through 3E, similar problems existed because the head generating part, i.e., pressure generating means, is integrally formed on the nozzle and the pressure chamber.

Recently, a disposable head integrally having a printing head and an ink head in the form of a head cartridge has been developed, and the entire head cartridge is replaced when all of the ink within the tank is consumed. However, according to such a printing head, the pressure generating means is disposed of at the same time, and there are problems in that the cost of the head is high and the running (i.e., operating) cost is high.

SUMMARY OF THE INVENTION

Accordingly, it is a general object of the present invention to provide a novel and useful printing head in which the problems described above are eliminated.

Another and more specific object of the present invention is to provide a printing head for an ink jet printing system and comprising a pressure chamber supplied with ink, a nozzle communicating with the pressure chamber, a vibration plate forming one wall of the pressure chamber, pressure applying means, i.e., pressure generating means, for applying pressure to the vibration plate so as to eject the ink from the nozzle, where the pressure applying means includes a wire for applying pressure to the vibration plate and a driving part for displacing the wire and a support means for resiliently supporting the vibration plate. The support means may be a resilient member interposed between the pressure chamber and the vibration plate. According to the present invention, it is possible to perform satisfactory printing with low noise.

A printing head in which at least the pressure chamber is detachably provided with respect to the pressure applying means is disclosed. According to this device, it is possible to realize a printing head having a high reliability and a low running cost.

A printing head which further comprises a resilient member provided on one of the vibration plate and the tip end of the wire is also disclosed. According to this device, it is possible to suppress the printing noise.

According to the present invention, it is possible to displace the vibration plate by a greater amount, but with the same power consumption, as compared to the extend of displacement of a prior art device in which no resilient member is provided.

A printing head which further comprises a wire guide for guiding the tip end part of the wire so that the tip end of the wire presses the central part of the vibration plate is further disclosed. According to this device, it is possible thereby to suppress the unstable movements of the tip end part of the wire and achieve stable printing.

A printing head which further comprises a projection provided on one of the vibration plate and the tip end of the wire, where the projection is provided at a position so as to press against the central-part of the vibration plate is yet further disclosed. According to this device, it is possible to positively press against the central part of the vibration plate regardless of the diameters of the wire and the vibration plate, thereby improving the nozzle density and enabling printing with a high density.

A printing head in which the vibration plate is made up of a plurality of stacked plates is still further disclosed. According to this device, it is possible thereby to suppress the residual vibration of the vibration plate and stably eject the ink.

A printing head in which the mass of the ink particles ejected from the nozzle is controlled by supplying to the driving part a driving signal which controls the pressure of the wire on the vibration plate from the pressure applying means is also disclosed. According to this device, it is possible thereby to make gradation printing having contrast.

Still further, a printing head which comprises bias means for supplying a bias voltage to the driving part so that the tip end of the wire makes contact with the vibration plate also at the time of non-printing is disclosed. According to this device, it is possible thereby to control the pressure with respect to the vibration plate, i.e., keep the pressure constant, and suppress the residual vibration of the vibration plate, thereby making it possible to make high quality printing.

Moreover, a printing head in which at least the pressure chamber is detachably provided with respect to the pressure applying means, and impact type printing, i.e., dot matrix printing, is possible by mounting an ink ribbon in place of the pressure chamber is disclosed. According to this device, it is possible thereby to selectively make an ink jet type printing head and an impact type printing head.

Other objects and further features of the present invention will be apparent from the following detailed description when read in conjunction with the accompanying drawings.

DESCRIPTION OF THE PREFERRED EMBODIMENTS

FIGS. 4A through 4E are diagrams for explaining a first embodiment of the present invention.

Figure 1:
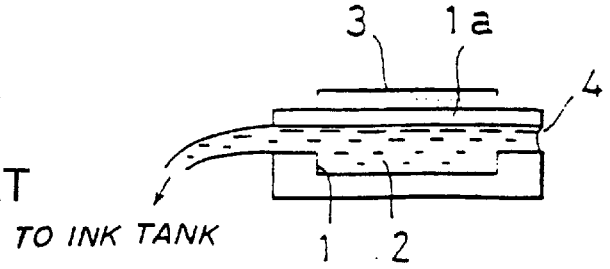
FIG. 1 PRIOR ART
FIG. 1 is a cross sectional view showing an essential part of an example of a conventional printing head.
Figure 2A:
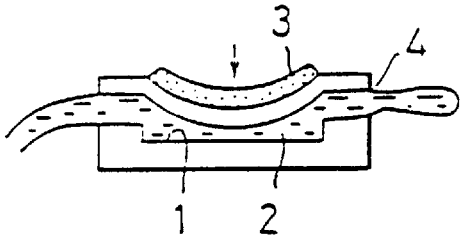
FIG. 2A PRIOR ART
FIGS. 2A and 2B respectively are cross sectional views for explaining the operation of the printing head shown in FIG. 1.
Figure 2B:
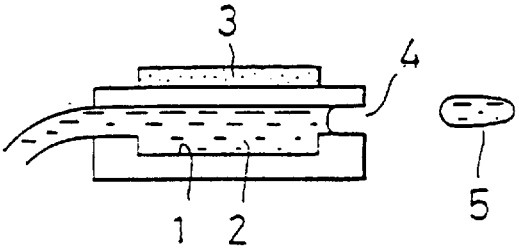
FIG. 2B PRIOR ART
Figure 3A:
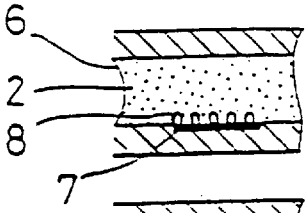
FIG. 3A PRIOR ART
FIGS. 3A through 3E respectively are cross sectional views showing an essential part of another example of a conventional printing head for explaining the same.
Figure 3B:
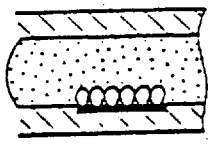
FIG. 3B PRIOR ART
Figure 3C:
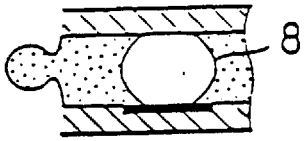
FIG. 3C PRIOR ART
Figure 3D:
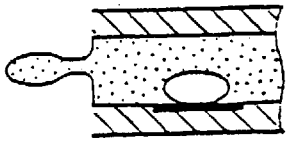
FIG. 3D PRIOR ART
Figure 3E:
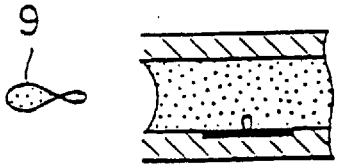
FIG. 3E PRIOR ART
Figure 4A:
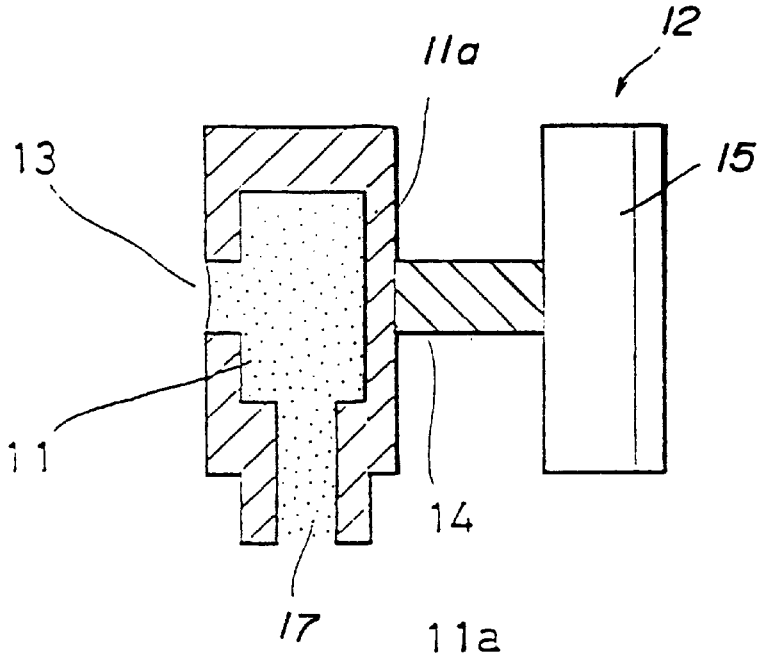
FIGS. 4A through 4E respectively are cross sectional views showing an essential part of a first embodiment of a printing head according to the present invention for explaining the same.

FIG. 4A is a cross sectional view showing the general structure of this embodiment. A pressure chamber 11 communicates with a nozzle 13 and also with an ink tank which is not shown. A pressure applying mechanism 12 is made up of a displacement transmitting part 14 such as a wire, and a driving part 15 which displaces the displacement transmitting part 14 depending on a print signal so as to generate pressure in the pressure chamber 11.

A wire magnetic type drive of the normal wire dot printing head, a stacked type piezoelectric element, or a piezoelectric element having a displacement enlarging mechanism may be used as the driving part.

Figure 4B:
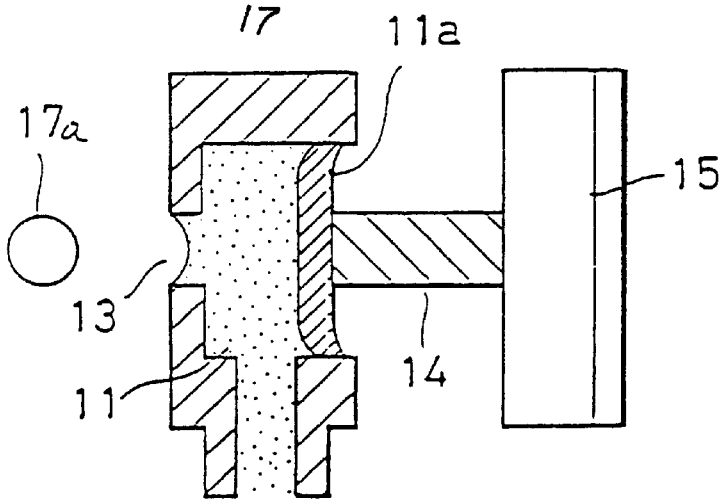
Figure 4C:
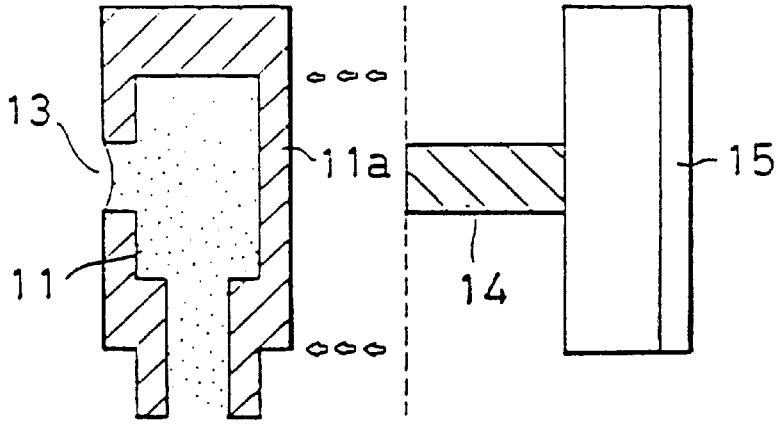
Figure 4D:
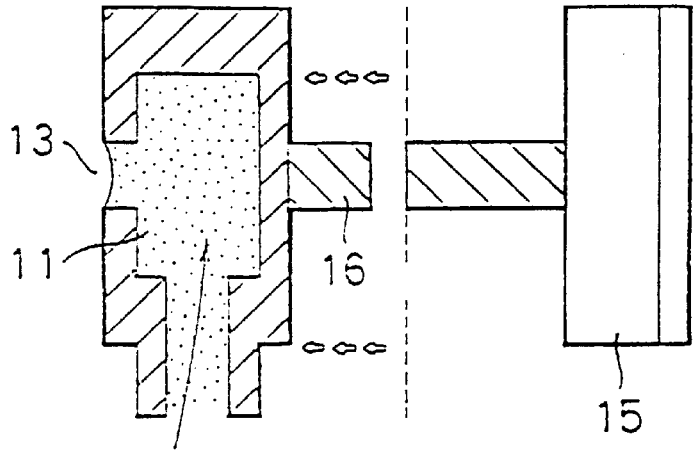
Figure 4E:
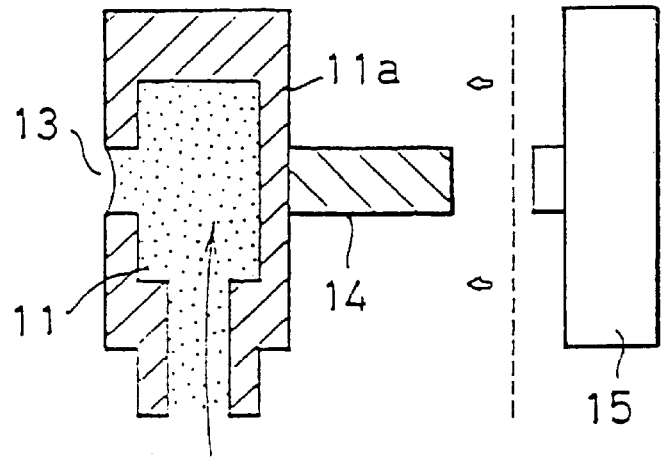

In FIGS. 4A through 4E, an outer wall 11*a* of the pressure chamber 11 and the pressure applying mechanism 12 are separable. The separating point is as shown in FIGS. 4C through 4E. FIG. 4C shows a case where the separation takes place between a tip end of the displacement transmitting part 14 which is a wire, FIG. 4D shows a case where the separation takes place at an intermediate part of the displacement transmitting part 14 and a tip end part 16 fixed to the side of the outer wall (vibration plate) 11*a*, and FIG. 4E shows a case where the separation takes place between a base part of the displacement transmitting part 14 and the remainder of the displacement transmitting part 14 which is fixed to the outer wall 11*a*. In each case, the printing head is assembled so that the pressure chamber side and the driving part side confront each other with a fine gap at the separation point or in a state where the two make contact.

In addition, if the wire magnetic type drive wire dot printing head is used for the pressure applying mechanism, it is possible to separate the outer wall 11*a* and the pressure applying mechanism and arrange the wire so that the tip end of the wire makes contact with the outer wall 11*a*.

When the parts on the pressure chamber side and the parts on the driving part side, which are independently made are assembled in a separable manner, it is possible to replace only the parts on the pressure chamber side. Accordingly, after the ink within the ink tank, which is included in the parts on the pressure chamber side, is consumed, only the parts on the pressure chamber side are removed and disposed of, and there is an economical advantage in that the parts on the driving part side including the pressure generating means do not need to be disposed of.

In the present invention, the wire magnetic type drive or the like is used as the driving part, and it is possible to make the displacement of the displacement transmitting part 14 such as the wire large. For example, in the case of the wire (dot pin) used in the normal wire dot type printer, the displacement is on the order of 200 pm. The displacement of the piezoelectric element is on the order of 0.1 $\mu$m.

Accordingly, even if a gap on the order of 30–50 $\mu$m is formed between the outer wall 11*a* and the tip end of the displacement transmitting part 14, when the parts on the pressure chamber side and the parts on the driving part side are assembled, due to poor precision of these parts, the capacity of the pressure chamber 11 is sufficiently reduced by the displacement of the wire.

The driving part 15 is operated when carrying out the printing. Hence, the displacement transmitting part 14 moves a predetermined quantity to the left as shown in FIG. 4B, and displaces the outer wall 11*a* by pushing on the outer wall 11*a*. As a result, pressure is applied to the ink within the pressure chamber 11, and ink particles, i.e., droplets, 17*a* are ejected from the nozzle 13.

Next, a description will be given of a second embodiment of the present invention by referring to FIGS. 5A through 13B.

Figure 5A:
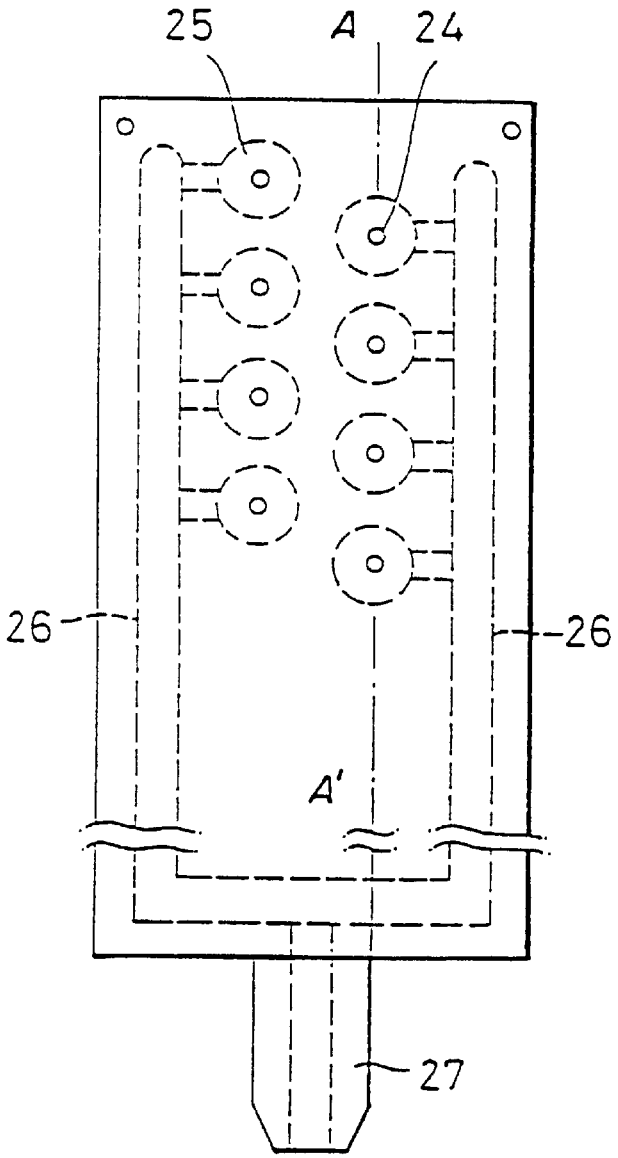
FIGS. 5A and 5B respectively are a plan view and a cross sectional view showing an essential part of a second embodiment of the printing head according to the present invention.
Figure 5B:
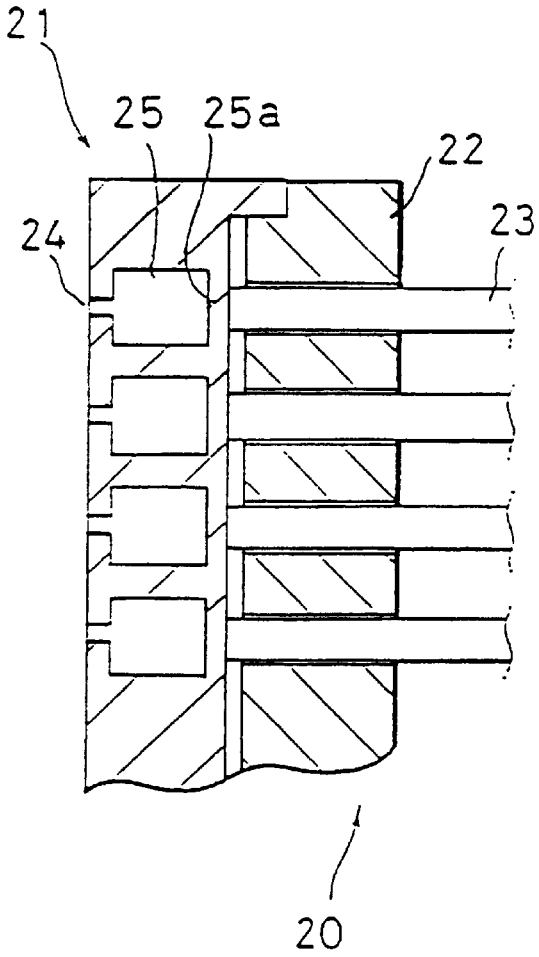

FIGS. 5A and 5B are diagrams for explaining the structure of this embodiment of the printing head, where FIG. 5A is a front view, and FIG. 5B is a cross sectional view taken along a line A–A' in FIG. 5A.

Figure 6:
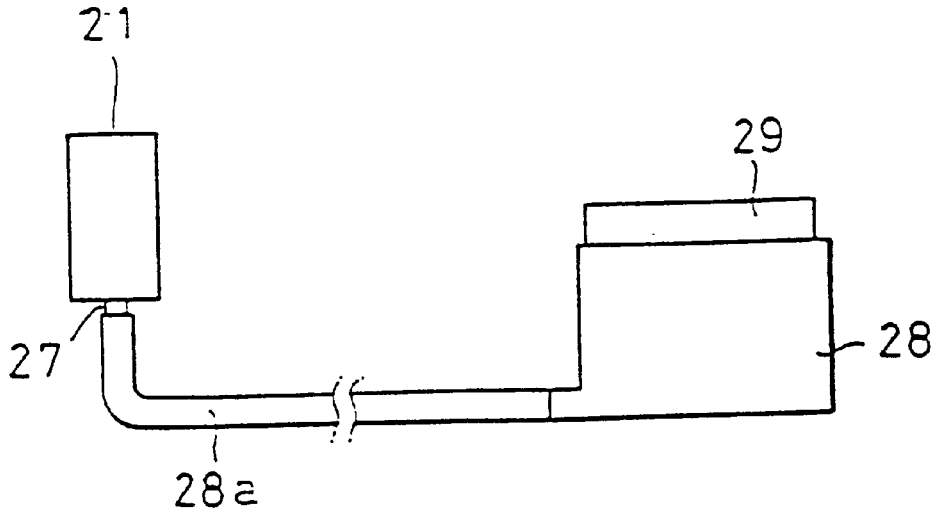
FIG. 6 is a diagram for explaining the connection of an ink cassette and an ink tank in the 5 second embodiment.

An ink cassette 21 is provided with a plurality of nozzles 24, for example, twenty-four nozzles 24, which are arranged in two rows in an alternate manner, and a pressure chamber which communicates with each nozzle 24, and each pressure chamber 25 communicates to an ink supply opening 27 via an ink supply passage 26. The ink supply opening 27 is connected to an ink tank cassette 28 via a connection hose 28*a*, as shown in FIG. 6. The ink tank cassette 28 accommodates an ink tank cartridge 29 in a detachable manner, and supplies the ink to the ink supply opening 27. The diameter of the nozzle 24 must suit the resolution which is required by the printer, and 50 $\mu$m is required in order to obtain the resolution of 300 dpi, for example.

Figure 7:
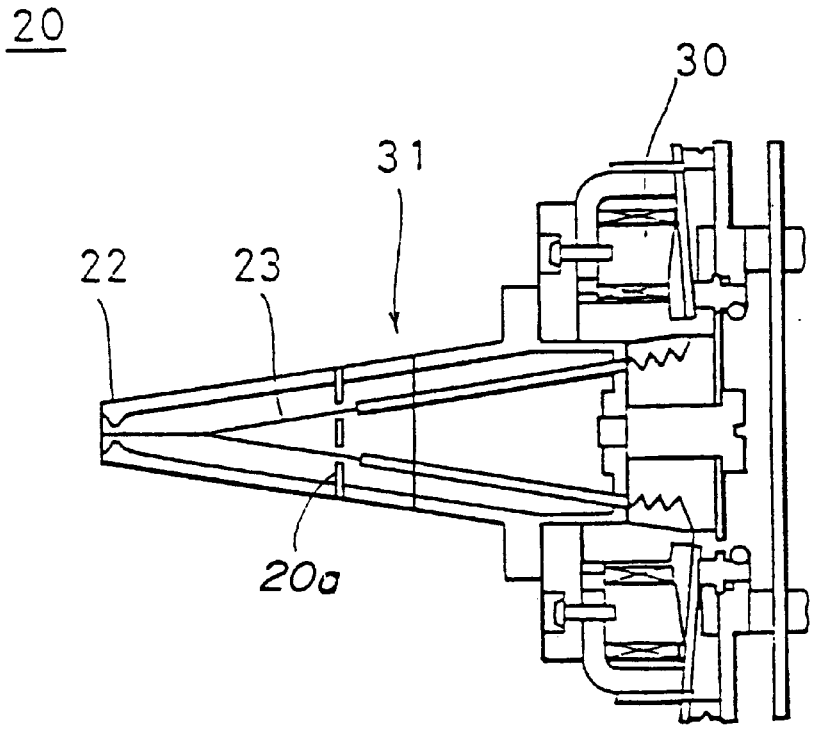
FIG. 7 is a cross sectional view showing a pressure applying mechanism of the second embodiment.

A pressure applying mechanism 20 having the structure shown in FIG. 7 is used. FIG. 7 shows a known electromagnetic drive type which is used in the normal wire dot printing head. For example, a wire dot printing head used in a printer F6123F1 manufactured by Fujitsu Limited of Japan or the like may be used as this printing head. An electromagnetic attraction part 30 is provided with a coil, an armature, a return spring and the like. A driving part 31 corresponds to the driving part 15 of the first embodiment, and does not include a wire (displacement transmitting part) 23 of the pressure applying mechanism 20. This wire dot printing head part is provided with a number of wires matching the number of nozzles and pressure chambers of the ink cassette 21, and the electromagnetic attraction part 30 is provided in correspondence with each wire.

In other words, when the wire dot printing head of the embodiment is used, the wire pins are bent from the driving part (electromagnetic attraction part) by a guide 20*a* within a case 31*a*, and the tip ends can be arranged with a fine gap therebetween. For this reason, the pressure chamber and the nozzle can be arranged close together, and it is possible to realize the multi-nozzle type ink jet printing head shown in FIGS. 5A and 5B.

Figure 8:
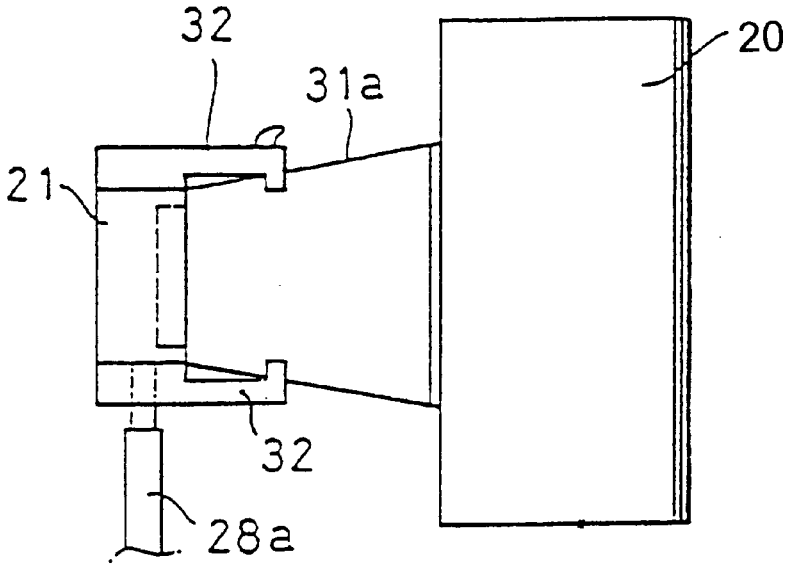
FIG. 8 is a side view showing the second embodiment in the assembled state.

The printing head is assembled from the ink cassette 21 and the pressure applying mechanism 20 as shown in FIG. 8. In this printing head, pins 32 mounted on the top and bottom of the ink cassette 21 engage depressions provided in the case 31*a* of the wire dot printing head which is used as the driving part 31. In this state, the tip end of the wire 23 which is the displacement transmitting part confronts an outer wall 25*a* of the pressure chamber 25 with a fine gap therebetween or makes contact with the outer wall 25*a*, as shown in FIG. 5B. In addition, the tip end part of each wire 23 is guided by the wire guide 22. The printing by this printing head is carried out by supplying a current to the coil of the electromagnetic attraction part having the wire for displacing the pressure chamber which communicates to the nozzle 24 which is to eject the ink. The electromagnetic part being supplied with current is one of the electromagnetic attraction parts 30, each being positioned in correspondence with one of the wires 23. Since the printing head is assembled in this manner, the ink cassette 21 can easily be separated from the pressure applying mechanism 20 side and removed for maintenance or replacement, and it is possible to improve the reliability and reduce the running cost. compared to the conventional wire dot type printer having the noise level of 55 to 65 dB, it was possible to realize a noise level on the order of 45 dB. Moreover, the noise can further be reduced by using a cover structure for the pins 32 of the ink cassette 21 so that the case 31*a* of the wire dot printing head is covered. It is possible to completely eliminate the noise if the ink cassette 21 is constructed not to separate from the pressure applying mechanism side.

In this embodiment, the description was given for the separation type, i.e., point of separation shown in FIG. 4C. However, it is possible to obtain similar effects by employing the separation type shown in FIG. 4D or 4E in which some or all of the wires 23 are fixed to the outer wall 25*a*.

In this embodiment, the diameter of the nozzle 24 is 50 μm, the length (thickness) of the nozzle 24 is 200 μm, the pitch of the nozzles 24 is 280 μm, the diameter of the pressure chamber 25 is 500 μm, the length (thickness) of the pressure chamber 25 is 100 μm, the thickness of the outer wall 25*a* is 50 μm, the diameter of the wire 23 is 200 μm, and the external dimensions of the ink cassette 21 shown in FIG. 5A is 2.0 mm×4.0 mm. Materials such as stainless steel, resin and glass may be used for the head part of the ink cassette 21, and this embodiment uses 304 stainless steel SUS304. Materials such as acrylic resin and polycarbonate resin may be used for the ink tank and the periphery of the head part. The passages may be formed by a known technique such as etching.

It was possible to carry out satisfactory printing in this embodiment using an ink having a black dye having a surface tension of 52 dyne/cm and a coefficient of viscosity of 4 cp, a driving voltage of 100 V and a driving frequency of 5 kHz. The displacement of the wire was on the order of 20 μm. The velocity of the injected ink particles was in the range of 6 to 10 m/s.

The advantage of using the wire drive is that a large displacement on the order of 100 μm can be obtained as compared to the displacement on the order of 0.1 μm obtainable by the normal piezoelectric element. For this reason, the pressure chamber side and the driving part side may be detachable. In addition, even when the pressure chamber is small, it is possible to apply a sufficiently large displacement to the pressure chamber as described above, thereby making it possible to positively eject the ink.

The driving condition was varied to vary the displacement and investigate the ink particles, and it was found that no pressure is generated within the pressure chamber 25 and no displacement was observed in the meniscus within the nozzle 24 if the displacement is 1 μm or less. The appropriate displacement of the wire 23 for ejecting the ink particles is 1 to 200 μm, and a particularly satisfactory ejection was obtained in the range of 5 to 80 μm.

The appropriate dimensions are 30 to 80 μm for the diameter of the nozzle 24, 50 to 400 μm for the length (thickness) of the nozzle 24, 100 to 500 μm for the diameter of the pressure chamber 25, 50 to 200 μm for the length (thickness) of the pressure chamber 25, and 10 to 200 μm for the thickness of the outer wall 25*a*. In addition, the appropriate diameter of the wire 23 is 120 to 200 μm and the stroke is 5 to 80 μm.

The composition of the ink affects the particle characteristic. It is possible to use a liquid ink having a coefficient of viscosity of 1 to 30 cp. Further, it is possible to use an ink having a surface tension of 30 to 70 dyne/cm.

Figure 9:
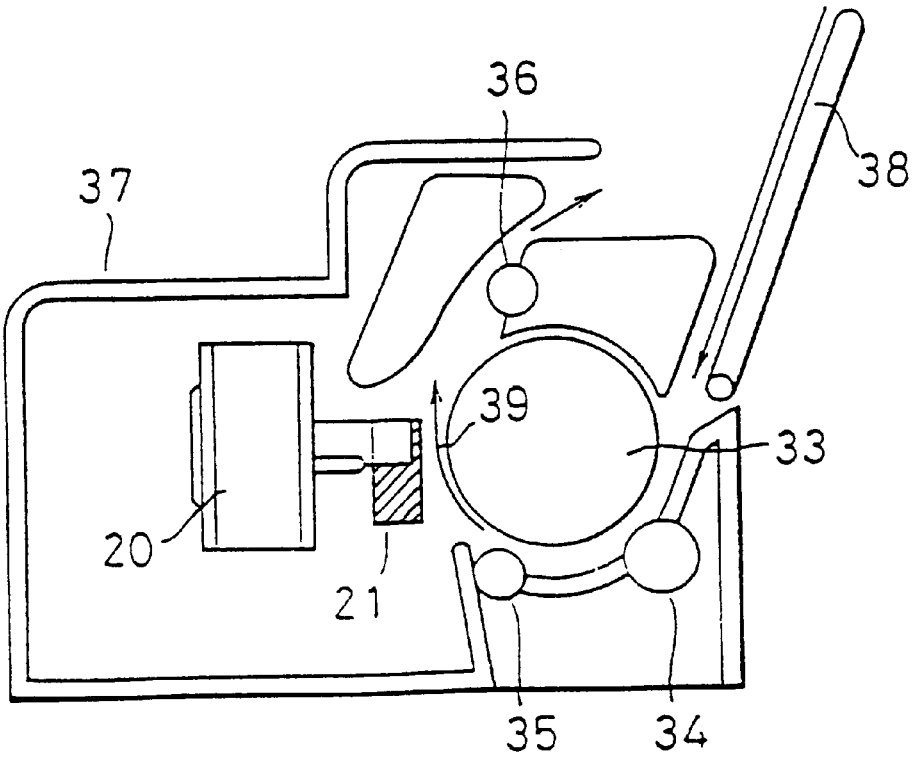
FIG. 9 is a cross sectional view showing an essential part of a printer to which the second embodiment is applied.

FIG. 9 generally shows the printer which has the above described printing head. The printer generally includes a platen 33, guide rollers 34, 35 and 36, a printer cover 37, and a paper guide 38. The paper is transported on the paper guide as indicated by an arrow 39 and is supplied to a printing part, and the printing is carried out by adhering the ink particles ejected from the nozzle of the ink cassette 21 onto the paper. When carrying out this printing, it is possible to print characters, having a dot structure by arranging twelve nozzles 24 in two rows as shown in FIG. 5A and selectively driving the nozzles while scanning in the width direction of the paper with a carrier which carries the printing head.

Figure 10A:
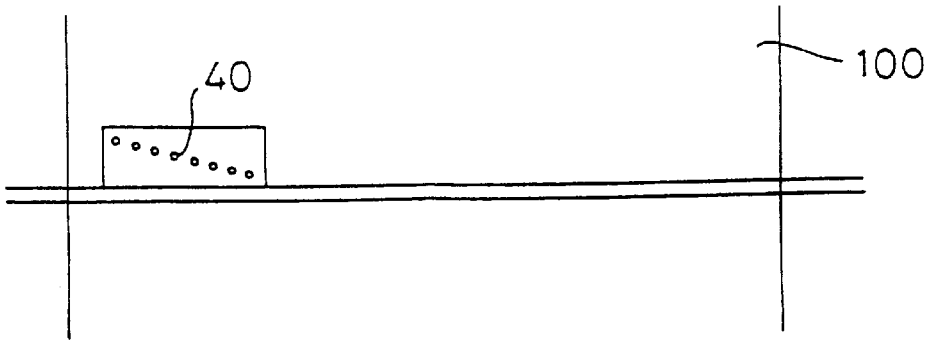
FIGS. 10A through 10C respectively are diagrams for explaining embodiments of the nozzle arrangements.
Figure 10B:
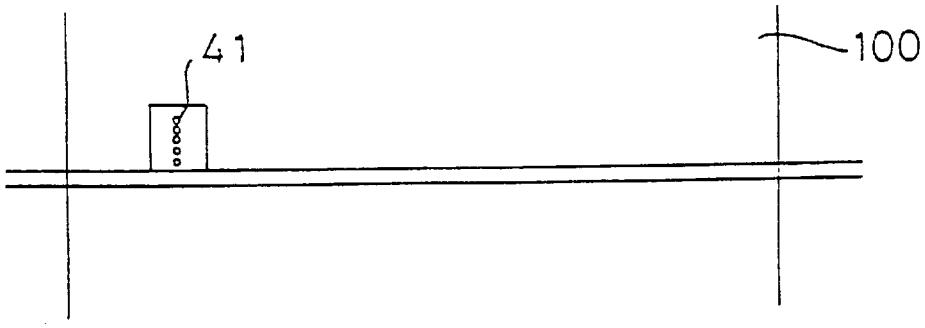
Figure 10C:
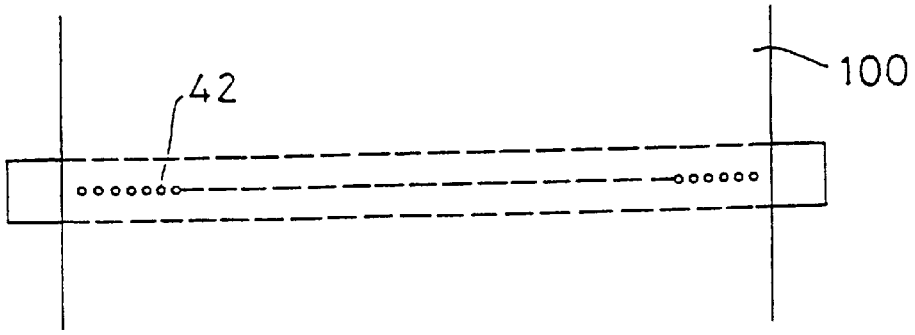

FIGS. 10A through 10C show embodiments of the nozzle arrangement. In the case shown in FIG. 10A, a plurality of nozzles 40 are linearly arranged obliquely to the width direction (right and left direction in FIG. 10A) of a recording paper 100. In the case shown in FIG. 10B, a plurality of nozzles 41 are linearly arranged in a transport direction of the recording paper 100. In the case shown in FIG. 10C, a plurality of nozzles 42 are linearly arranged for the full width of the recording paper 100 along the width direction of the recording paper 100. In the cases shown in FIGS. 10A and 10B, the printing is carried out by scanning the width of the recording paper with the carrier.

The actual printing condition of this printer and the printed result are as follows.

A head made by a trial manufacture has a structure such that the nozzle diameter is 50 μm, the nozzle length is 200 μm, the pressure chamber diameter is 500 μm, and the depth is 100 μm. Furthermore, a driving system was also made by trial manufacture under the condition that the wire diameter be 200 μm. This driving system may use the electromagnetic attraction type drive of the normal wire dot type printer, without modifications. Materials such as stainless steel, resin and glass may be used for the nozzle head (ink cassette), but stainless steel was used in this case. The passages were made by a known technique such as etching. It was possible to carry out satisfactory printing using an ink having a black dye having a surface tension of 52 dyne/cm and a coefficient of viscosity of 4 cp, a driving voltage of 30 V and a driving frequency of 3 kHz. The displacement of the wire was on the order of 20 μm, and the velocity of the ejected ink particles was in the range of 6 to 10 m/s.

The advantage of using the wire type drive is that a large displacement can be obtained as compared to the displacement (approximately 0.1 μm) obtainable by the normal piezoelectric element. For this reason, the pressure chamber side and the driving part side can be made detachable. The driving condition was varied to vary the displacement and investigate the ink particles, and it was found that no pressure is generated within the pressure chamber and no displacement was observed in the meniscus within the nozzle if the displacement is 1 μm or less. The appropriate displacement of the wire for ejecting the ink particles is 1 to 200 μm, and a particularly satisfactory ejection was obtained in the range of 5 to 80 μm.

In this embodiment, the nozzle, the pressure chamber and the ink tank can be removed unitarily from the driving part to be replaced when all of the ink within the ink tank cassette is consumed. For this reason, the size of the cassette can be made small, and it is economical in that the driving part is used continuously, i.e., does not have to replaced at the time of cassette replacement.

Figure 11:
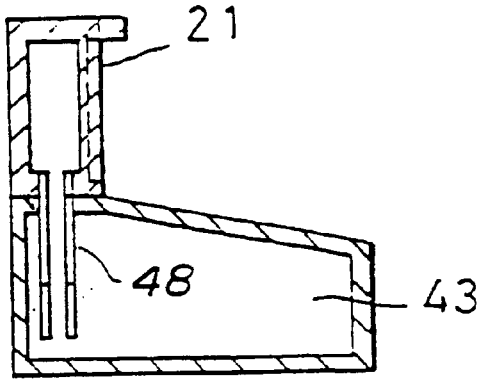
FIG. 11 is a cross sectional view showing the connection of an ink cassette and an ink tank in a third embodiment of the printing head according to the present invention.
Figure 12:
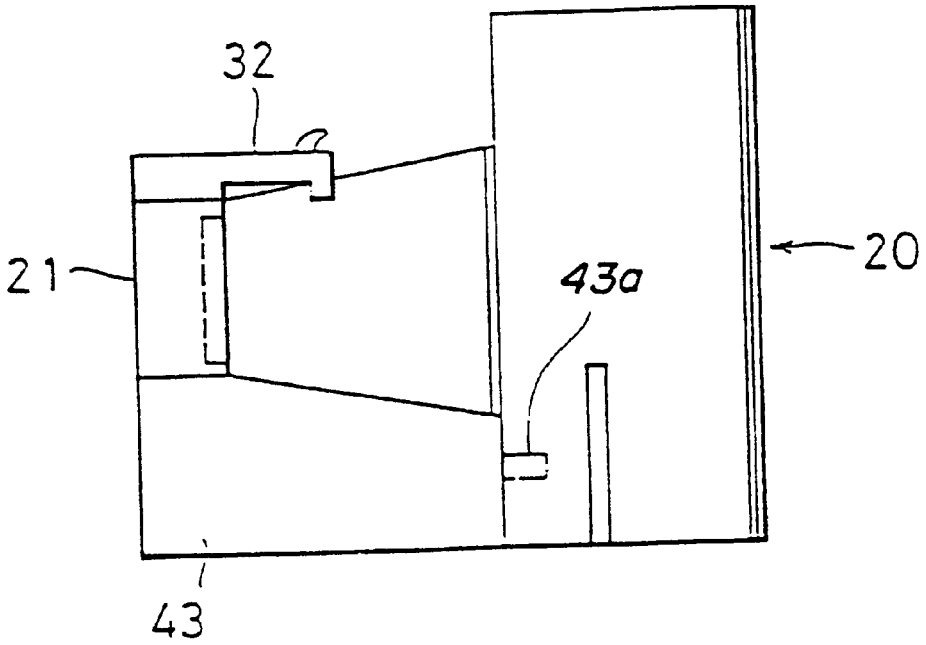
FIG. 12 is a side view showing the third embodiment in the assembled state.

According to the above embodiment, the ink cassette and the ink tank (ink tank cassette) are connected via a connection hose as shown in FIG. 6, but the ink cassette 21 and the ink tank 43 may be integrally formed as in the case of a third embodiment shown in FIG. 11. In this case, the ink cassette 21 and the ink tank 43 are connected via a supply tube 48. FIG. 12 shows a printing head which is obtained by assembling the ink cassette 21 on the wire dot printer type pressure applying mechanism 20, and pins 32 are provided similarly as in the case shown in FIG. 8. In addition, a pin 43*a* provided on the ink tank 43 engages a depression on the pressure applying mechanism 20 side so as to enable positioning.

Figure 13A:
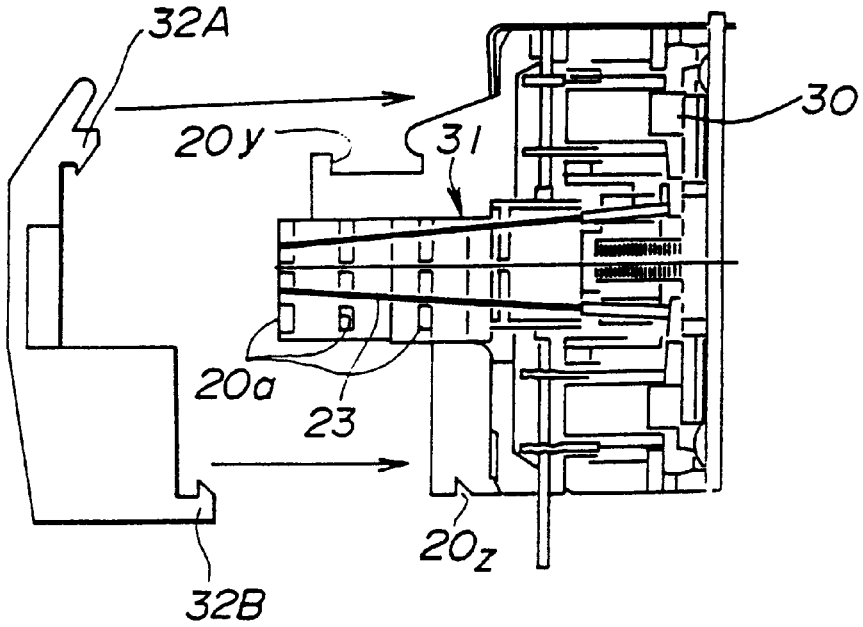
FIGS. 13A and 13B respectively are partial cross sectional views showing the case where the third embodiment is employed in the pressure applying mechanism shown in FIG. 7.
Figure 13B:
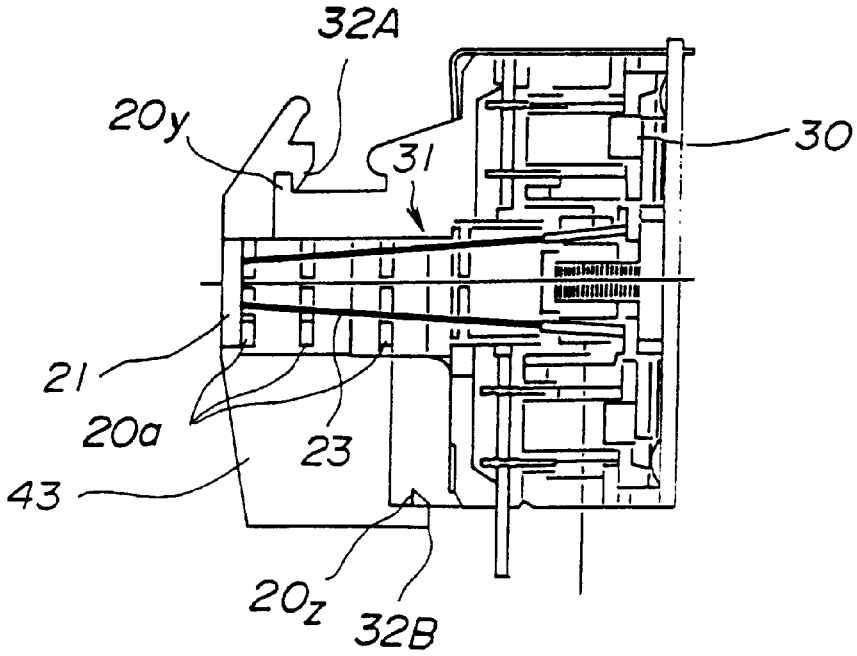
Figure 14:
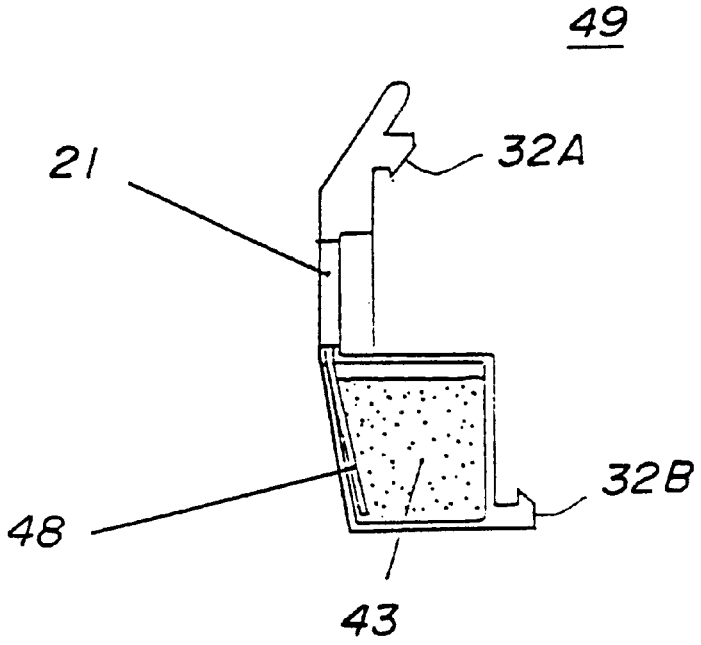
FIG. 14 is a cross sectional view showing a nozzle cassette.

FIGS. 13A and 13B show a case where the third embodiment is employed in the pressure applying mechanism 20 shown in FIG. 7. FIG. 13A is an exploded view and shows the invention before a nozzle cassette 49 is assembled and mounted on the pressure applying mechanism 20, and FIG. 13B shows a state where the nozzle cassette 49 is mounted on the pressure applying mechanism 20. FIG. 14 shows a nozzle cassette 49 which integrally comprises the ink cassette 21 and the ink tank 43. In FIGS. 13A, 13B and 14, those parts which are essentially the same as those corresponding parts in FIGS. 7, 11 and 12 are designated by the same reference numerals, and a description thereof will be omitted. In FIG. 13A, claws 32A and 32B correspond to the pins 32. The claws 32A and 32B respectively engage a projection 20*y* and a depression 20*z* which are provided on the pressure applying mechanism 20, and an accurate positioning is achieved between the plurality of nozzles on the cassette side and the wire pins 23 of the pressure applying mechanism 20.

Figure 15:
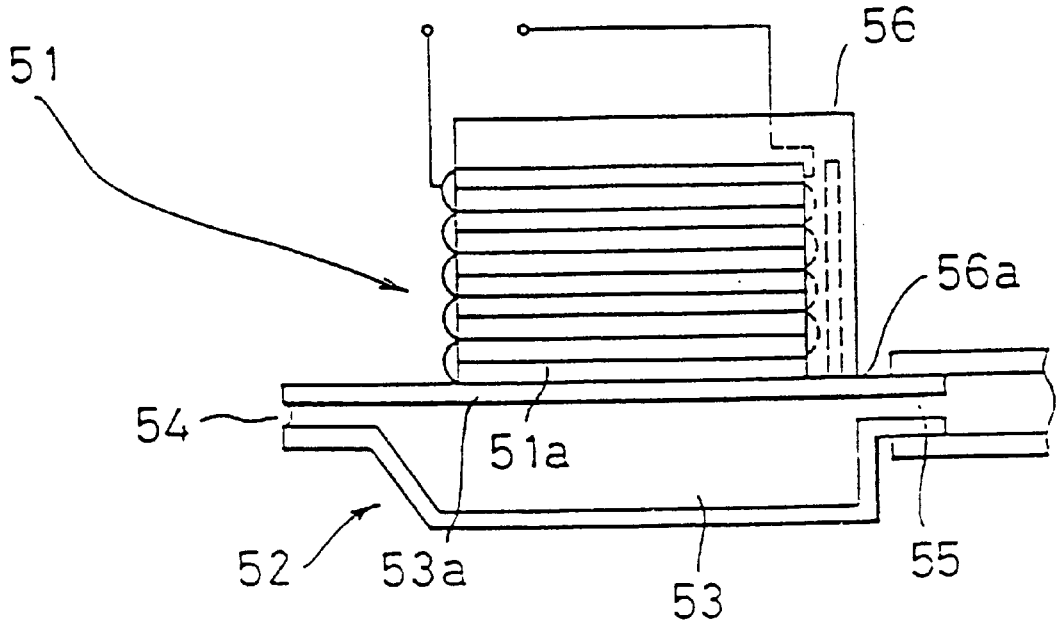
FIG. 15 is a cross sectional view showing a pressure applying mechanism of a fourth embodiment of the printing head according to the present invention.

In addition, in the above embodiment, it is described that the electromagnetic type drive head is used as the pressure applying mechanism, but it is also possible to use a stacked type piezoelectric element 51 as the pressure applying mechanism as in the case of a fourth embodiment shown in FIG. 15. In FIG. 15, an ink cassette 52 includes a pressure chamber 53, a nozzle 54 and an ink supply opening 55, and a bottom part 51*a* of the stacked type piezoelectric element 51 pushes against an outer wall 53*a* of the pressure chamber 53 by a pushing part 56. A lower end part 56*a* of the pushing part 56 is detachably mounted on the outer wall 53*a*, and the stacked type piezoelectric element 51 can be removed from the ink cassette 52 by separating the lower end part 56*a* from the outer wall 53*a*. The bottom part 51*a* of the stacked type piezoelectric element 51 corresponds to the displacement transmitting part of the pressure applying mechanism, and the other parts correspond to the driving part.

Unlike the normal piezoelectric element having a displacement on the order of 0.1 $\mu$m, the stacked type piezoelectric element 51 has a displacement sufficient to operate the ink cassette 21. Hence, effects similar to those described above can be obtained by using the stacked type piezoelectric element 51 as the pressure applying mechanism.

In the first embodiment shown in FIGS. 4A and 4B, for example, the stationary position of the tip end of the displacement transmitting part 14 must be sufficiently separated from the outer wall 11*a* of the pressure chamber 11, similar to the case of the wire of the normal wire dot type printer, in order to efficiently transmit the energy of the driving part 15 to the pressure chamber 11. However, in order to effectively suppress the contact noise, the stationary position of the tip end of the displacement transmitting part 14 may make contact with the outer wall 11*a* of the pressure chamber 11 as shown in FIG. 4A, for example.

Next, a description will be given of embodiments in which the energy of the driving part 15 can be transmitted efficiently to the pressure chamber 11 and the contact noise can be suppressed.

Figure 16:
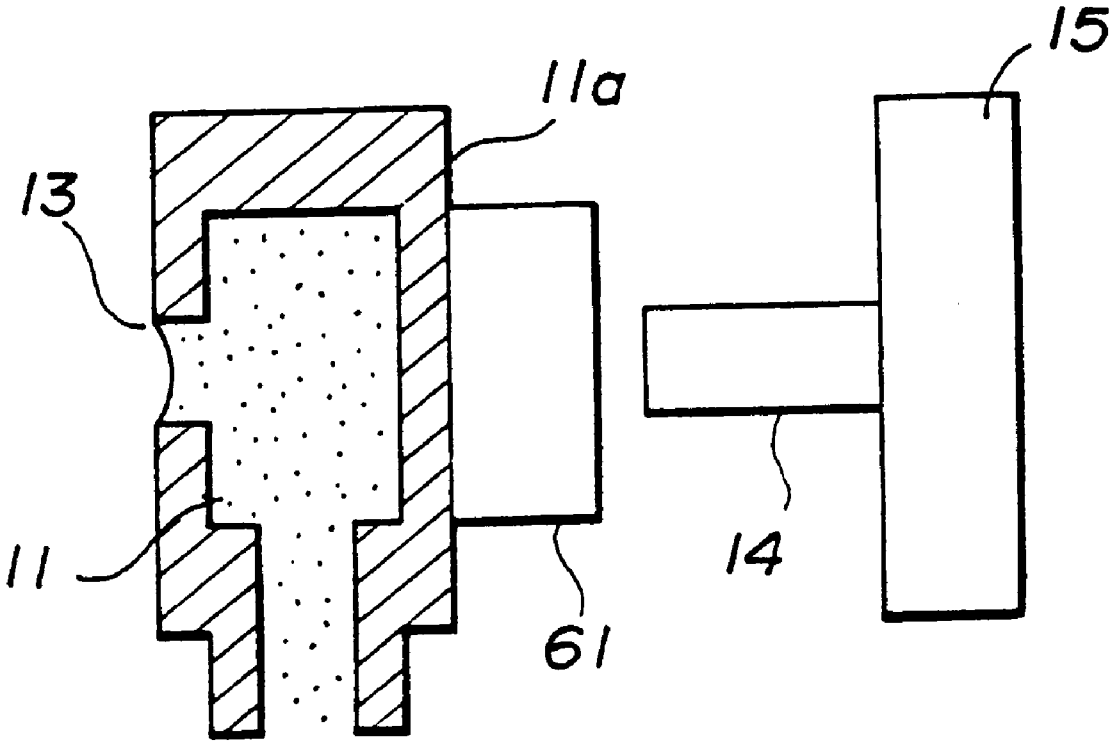
FIG. 16 is a cross sectional view showing an essential part of a fifth embodiment of the printing head according to the present invention for explaining the same.

FIG. 16 is a cross sectional view showing the general structure of a fifth embodiment of the printing head according to the present invention. In FIG. 16, those parts which are the same as those corresponding parts in FIG. 4A are designated by the same reference numerals, and a description thereof will be omitted. In this embodiment, a contractible member 61 is provided between the displacement transmitting mechanism (wire) 14 and the outer wall 11*a* of the pressure chamber 11. The member is fixed to the outer wall 11*a* in FIG. 16, but the member 61 may of course be fixed to the tip end of the displacement transmitting part 14. Resins such as polyester, polyamide, polystyrene and polyurethane, natural rubber, butadiene rubber, silicon rubber and the like may be used for the member 61.

Figure 17:
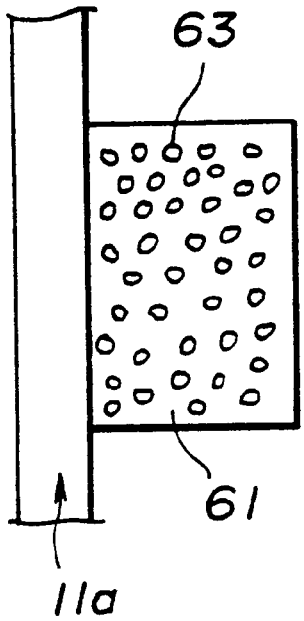
FIGS. 17 and 18 respectively are cross sectional views showing essential parts of modifications of the fifth embodiment.
Figure 18:
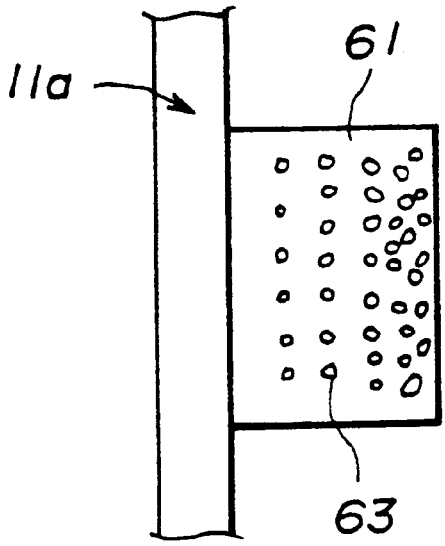

In order to improve the noise absorbing effect of the member 61, it is effective to use a resilient member having air bubbles 63 for the member 61 as in the case of a modification shown in FIG. 17. In addition, if the distribution density of the air bubbles 63 is made smaller towards the pressure chamber 11 as in the case of a modification shown in FIG. 18, the noise absorbing effect is further improved. In FIGS. 17 and 18, those parts which are the same as those corresponding parts in FIG. 16 are designated by the same reference numerals, and a description thereof will be omitted.

The noise level of the conventional wire dot type printer is 55 to 56 dB, but according to this embodiment, it was possible to suppress the noise level to approximately 45 dB by use of the member 61 having a thickness of 20 $\mu$m. The appropriate thickness of the member 61 can be varied from 10 to 200 $\mu$m, for example.

Figure 19:
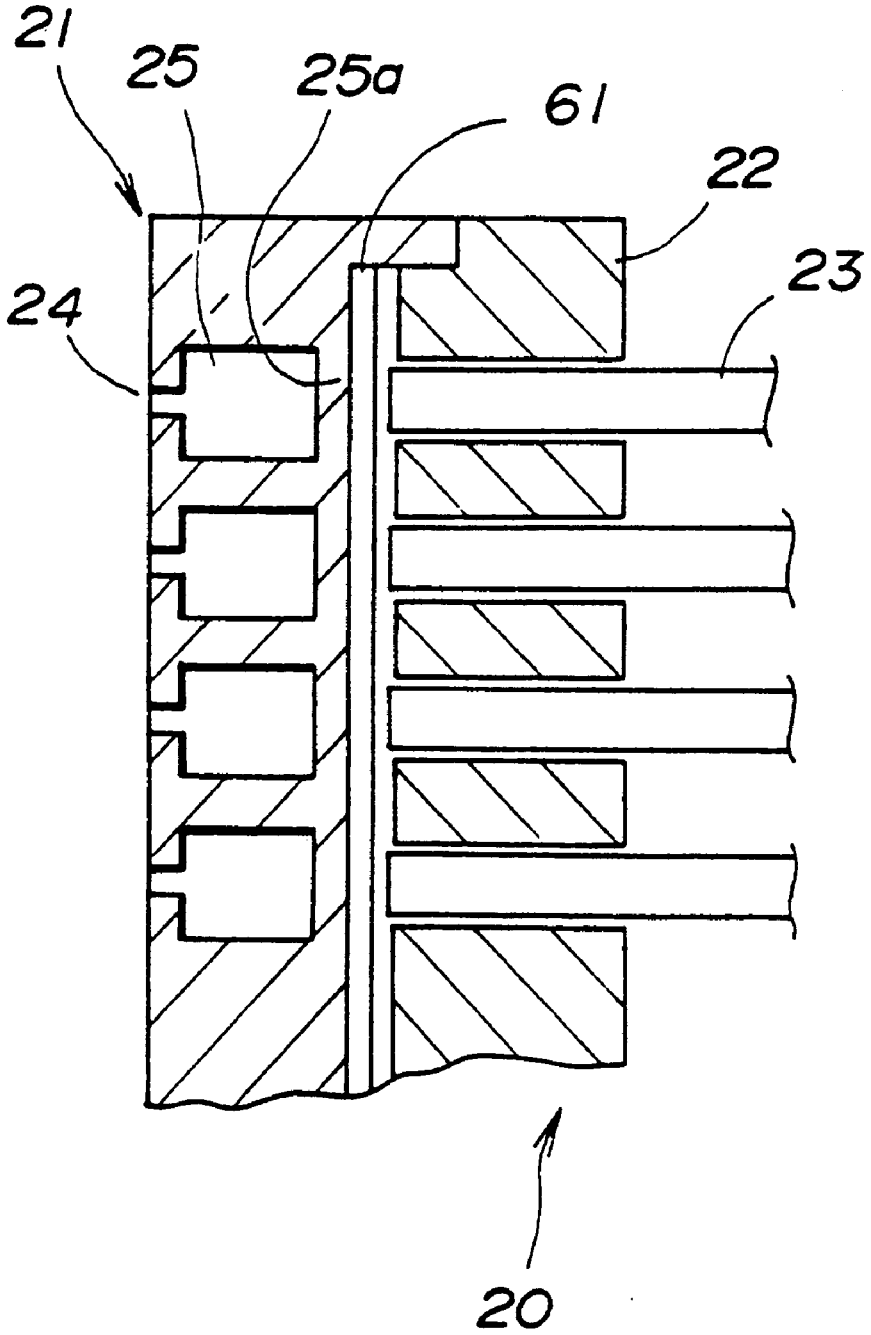
FIG. 19 is a cross sectional view showing an essential part of still another modification of the fifth embodiment.

In addition, when a plurality of nozzles 24 are provided as in the second embodiment, the member 61 may be provided along the outer wall 25*a* of the pressure chamber 25 as in the case of a modification shown in FIG. 19. In FIG. 19, those parts which are the same as those corresponding parts in FIGS. 5B and 16 are designated by the same reference numerals, and a description thereof will be omitted.

In each of the above embodiments, the outer wall of the pressure chamber is made of stainless steel, for example. Accordingly, in order to generate a pressure which is sufficient to eject the ink from the pressure chamber by applying the pressure to the outer wall, it is necessary to make the displacement of the outer wall relatively large. In addition, if the acting area of the outer wall is reduced in order to reduce the size of the printing head, it becomes necessary to proportionally increase the displacement of the outer wall. For this reason, even if the size of the printing head is reduced, the voltage applied to the driving part which drives the wires must be made large when the displacement of the outer wall is set large so as to positively eject the ink, and the power consumption becomes large.

Next, a description will be given of an embodiment in which the ink can be injected positively with a small power consumption even when the size of the printing head is reduced.

Figure 20:
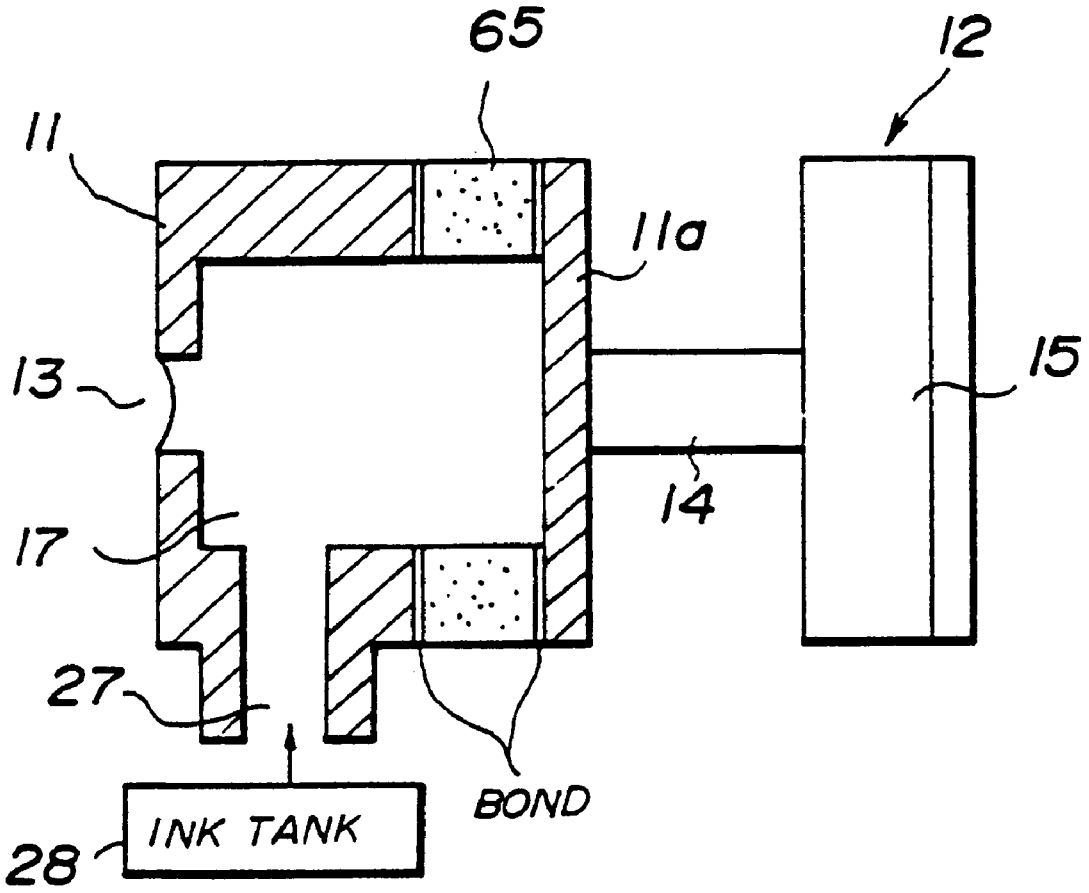
FIGS. 20 and 21 respectively are cross sectional views showing essential parts of a sixth embodiment of the printing head according to the present invention.
Figure 21:
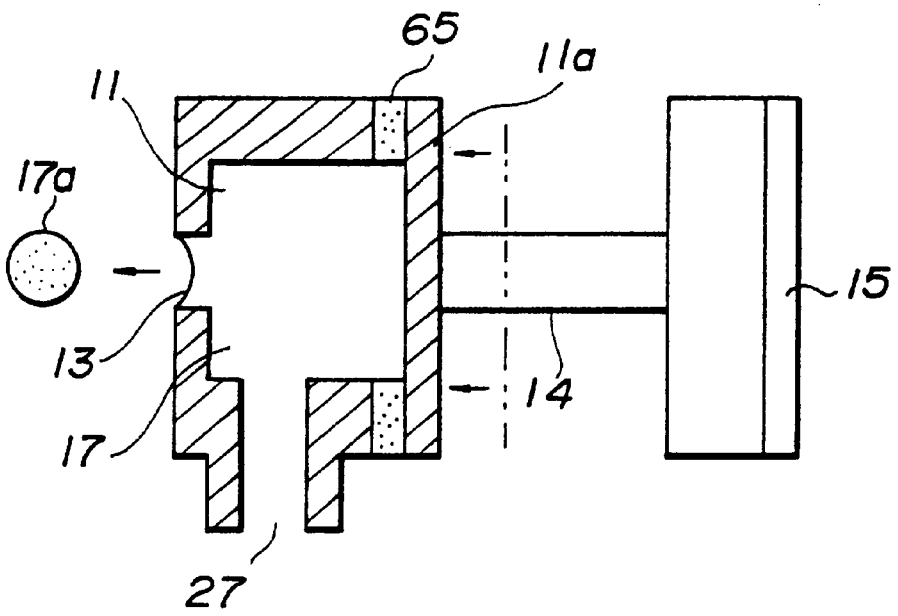

FIG. 20 shows an essential part of a sixth embodiment of the printing head according to the present invention. FIG. 21 shows a state where a voltage is applied to a driving part of the sixth embodiment. In FIGS. 20 and 21, those parts which are the same as those corresponding parts in FIG. 4A are designated by the same reference numerals, and a description thereof will be omitted.

In this embodiment, the outer wall 11*a* of the pressure chamber 11 forming the wall on the opposite side of the nozzle 13 is adhered to the rest of pressure chamber 11 by an epoxy resin system adhesive agent, for example, via a rubber plate 65 which has a ring shape and is made of a resilient material such as urethane. The thickness of the rubber plate 65 is 10 to 200 $\mu$m, and the modulus of elasticity is set to a range of $0.01\times10^7$ to $0.5\times10^7$ N/m$^2$. When a voltage is applied to the driving part 15, the displacement transmitting part 14 is displaced in the longitudinal direction as shown in FIG. 21 and presses the outer wall 11*a*. Hence, the outer wall 11*a* is bent towards the inside, but at the same time, the rubber plate 65 receives the pressure and is compressed, thereby further displacing the outer wall 11*a*. Thus, a pressure in the form of a pulse is generated within the pressure chamber 11, and the particles 17*a* of the ink 17 are ejected from the nozzle 13.

According to this embodiment, the outer wall 11*a* more easily undergoes displacement due to the resiliency of the rubber plate 65, and the outer wall 11*a* can be displaced sufficiently even when the pressure of the driving part 15 is relatively small. Hence, it is possible to positively eject the particles 17*a* of the ink 17.

In this embodiment, the diameter of the pressure chamber 11 is 500 μm, the length (thickness) of the pressure chamber 11 is 100 μm, the diameter of the nozzle 13 is 50 μm, the length (thickness) of the nozzle 13 is 200 μm, the thickness of the stainless steel outer wall 11*a* is 50 μm, the diameter of the displacement transmitting part (wire) 14 is 200 μm, and the displacement of the displacement transmitting part 14 is 20 to 50 μm. Under this condition, it was confirmed by experiment that a satisfactory printing can be carried out using an ink having a black dye having a surface tension of 52 dyne/cm and a coefficient of viscosity of 4 cp, and driving the driving part 15 by a driving voltage of 20 V and a driving frequency of 3 kHz. The displacement of the displacement transmitting part 14 in this case was on the order of 20 μm, and the velocity of the ejected particles 17*a* of the ink 17 was 6 m/s.

On the other hand, in the first embodiment shown in FIG. 4A having no rubber plate 65, it was necessary to use a driving voltage of 80 V in order to obtain the velocity of 6 m/s for the particles 17*a* of the ink 17 under the same condition as described above.

Figure 22:
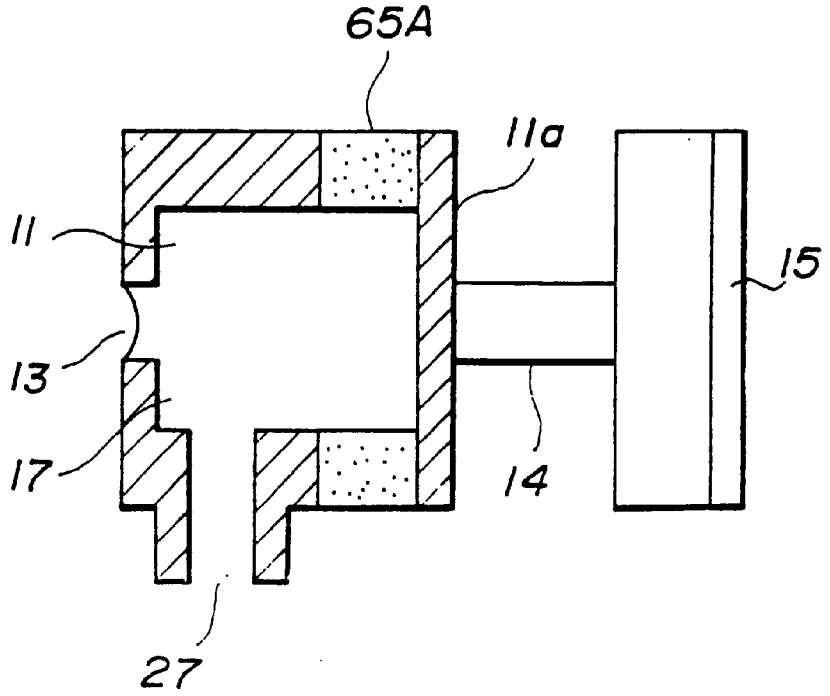
FIG. 22 is a cross sectional view showing an essential part of a modification of the sixth embodiment.

FIG. 22 shows a modification of the sixth embodiment. In FIG. 22, those parts which are the same as those corresponding parts in FIG. 20 are designated by the same reference numerals, and a description thereof will be omitted.

In this modification, a resin film 65A having desirable resilient and thermal adhesive characteristics is provided in place of the rubber plate 65.

That is, the outer wall 11*a* of the pressure chamber 11 forming the wall on the other side of the nozzle 13 has the desirable resilient and thermal adhesive characteristics, and is adhered by thermal adhesion on the pressure chamber 11 via the film 65A which is made of a ring shaped epoxy system adhesive resin film, for example. The thermal adhesion is made by inserting the film 65A at the part where the outer wall 11*a* of the pressure chamber 11 is to be mounted and heating it for one hour at 80° Celsius, for example, under pressure.

Accordingly, as in the case of the sixth embodiment, the outer wall 11*a* is easily displaced at the time of the driving due to the resiliency of the film 65A, and the particles 17*a* of the ink 17 can be injected positively. As a result of a printing experiment which was shown to be conducted, it was possible to obtain a velocity of 6 m/s for the particles 17*a* of the ink 17 using a driving voltage of 25 V and a driving frequency of 3 kHz under the conditions described above.

According to the sixth embodiment and its modification, it is possible to sufficiently displace the outer wall 11*a* even when the pressure of the driving part 15 is small. Hence, the voltage applied to the driving part 15 can be small. Therefore, the power consumption can be reduced, and the reliability is ensured even when the size of the printing head is reduced. Moreover, the running cost is reduced.

It was described that the resilient member 65 (or 65A) is made of urethane rubber or an epoxy system adhesive resin film, but it is also possible to use synthetic rubbers such as styrene butadiene rubber, butadiene rubber, blown rubber, acrylic rubber and silicone rubber, as well as natural rubber, and resin films other than the epoxy resin system film.

Figure 23:
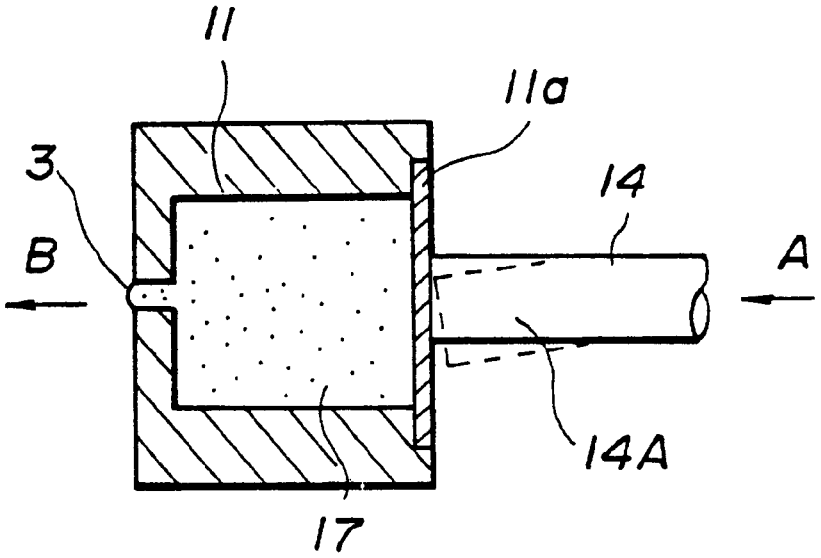
FIG. 23 is a cross sectional view for explaining unstable movement of a wire.

According to the structure in which a shock is applied to the outer wall (vibration plate) 11*a* by the projection of the displacement transmitting part (wire) 14 so as to eject the particles 17*a* of the ink 17 from the nozzle 13, a tip end 14*a* of the wire 14 may fluctuate as indicated by a dotted line in FIG. 23 when it hits the vibration plate 11*a*. In this case, the shock applied to the vibration plate 11*a* may weaken it, and shock may be applied to the vibration plate 11*a* two times. For this reason, the quantity, i.e., volume, and velocity of each of the ejected particles 17*a* of the ink 17 may decrease, and there is a possibility that the printing quality will deteriorate due to the double ejection. In FIG. 23, those parts which are essentially the same as those corresponding parts in FIG. 4A are designated by the same reference numerals, and a description thereof will be omitted.

Next, a description will be given of an embodiment in which the printing quality is improved by more positively ejecting the particles 17*a* of the ink 17.

Figure 24:
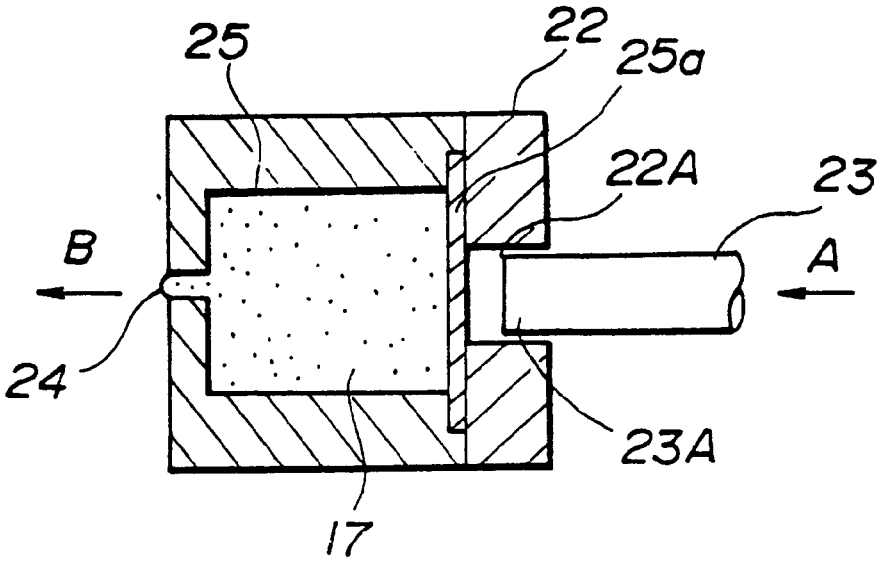
FIG. 24 is a cross sectional view showing an essential part of a seventh embodiment of the printing head according to the present invention.
Figure 25:
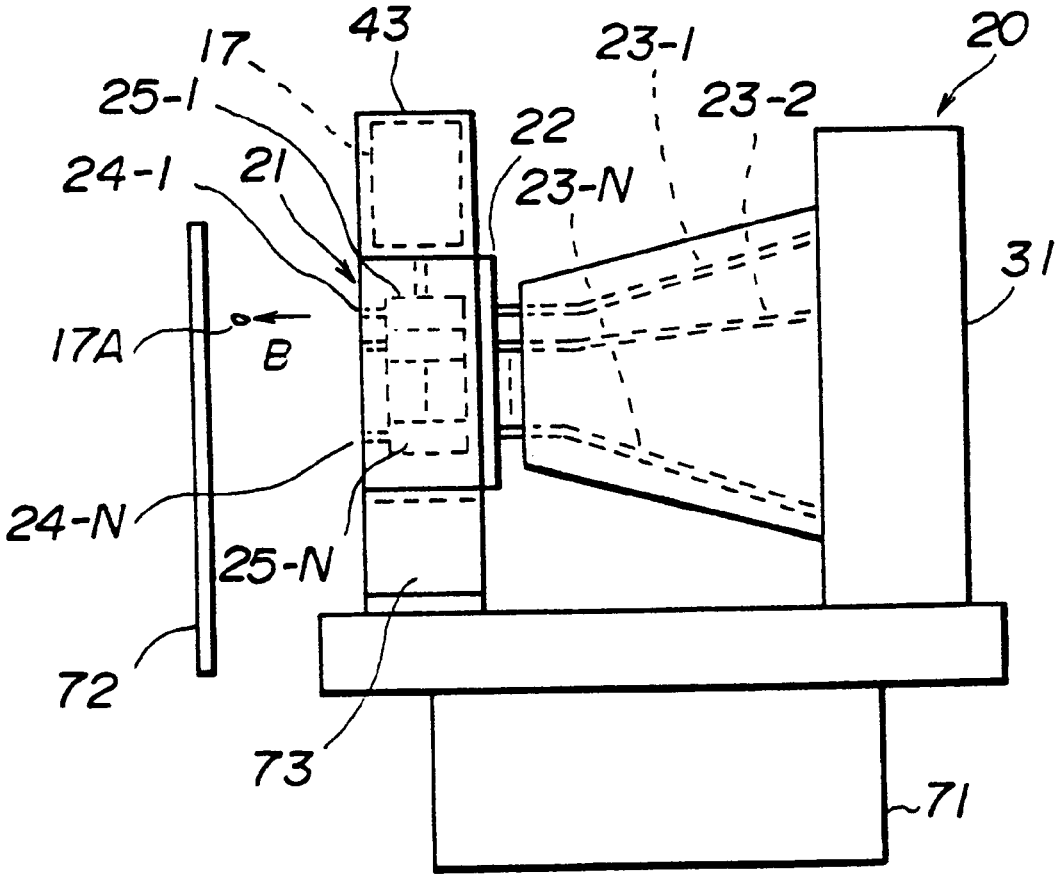
FIG. 25 is a side view showing the seventh embodiment.

FIG. 24 is a cross sectional view of an essential part of a seventh embodiment of the printing head according to the present invention, and FIG. 25 is a side view of the seventh embodiment. In FIGS. 24 and 25, those parts which are essentially the same as those corresponding parts in FIGS. 5A through 12 are designated by the same reference numerals, and a description thereof will be omitted.

In this embodiment, a wire guide 22 is provided adjacent to the pressure chamber 25. A penetration hole 22A is formed in the wire guide 22 so as to prevent the fluctuation, i.e., stray movement, of a tip end part 23A of the wire 23. The penetration hole 22A is formed at a position such that the tip end part 23A of the wire 23 pushes a predetermined part of the vibration plate 25*a*, and the predetermined position is the central part of the vibration plate 25*a* in this embodiment. Hence, the fluctuation of the tip end part 23A of the wire 23 is prevented, and a predetermined shock force is applied on the pressure chamber 25. For this reason, the particles 17*a* of the ink 17 can be ejected accurately, and it is possible to improve the printing quality.

In FIG. 25, the ink cassette 21 is made up of the ink tank 43, which stores the ink 17, and the plurality of pressure chambers 25 (25-1 through 25-N) which supply the ink 17 from the ink tank 43. This ink cassette 21 is fixed on a carriage 71 by a support 73.

In addition, the pressure applying mechanism 20 which is provided with a driving part 31 for driving and selectively projecting the plurality of wires 23 (23-1 through 23-N) is also fixed on the carriage 71.

The nozzles 24 (24-1 through 24-N) are formed in the respective pressure chambers 25, and the particles 17*a* of the ink are ejected in a direction shown by arrow B from a predetermined nozzle 24 by projecting the wire 23 to push the corresponding pressure chamber 24. A predetermined printing is made on a recording paper 72 by ejecting the particles 17*a* of the ink 17 in the direction shown by arrow B from the predetermined nozzle 24 and moving the pressure applying mechanism 20 and the ink cassette 21 by feeding the carriage 71. The nozzle 24 is provided on one end of the pressure chamber 25 and the vibration plate 25*a* is provided on the other end. Thus, the tip end part 23A of the wire 23 hits the vibration plate 25*a* when the wire projects in a direction shown by arrow A, and the particles 17*a* of the ink 17 are ejected in the direction shown by arrow B from the nozzle 24.

If the nozzles 24 (24-1 through 24-N) become blocked, the ink cassette 21 on the carriage 71 can be replaced by a new ink cassette by removing the support 73 in a state where the pressure applying mechanism 20 is fixed on the carriage 71. Hence, the printing process can be carried out immediately after the replacement of the ink cassette 21. Since the ink cassette 21 can be made at a low cost, it may be treated as consumption goods, i.e., a disposable product.

In this embodiment, the diameter of the penetration hole 22A is 10 to 100 μm greater than the diameter of the wire 23, and the length of the penetration hole 22A must be set larger than 10 to 200 μm if the projection quantity of the wire 23 is 10 to 200 μm. The diameter of the nozzle 24 is 50 μm, the length of the nozzle 24 is 200 μm, the diameter of the pressure chamber 25 is 500 μm, the length of the pressure chamber 25 is 200 μm, and the thickness of the vibration plate 25*a* is 100 μm. Furthermore, it was confirmed that a satisfactory printing can be made using as the ink 17 an ink having a black dye having a surface tension of 20 dyne/cm and a coefficient of viscosity of 2 cp, applying a driving voltage of 20 V and a driving frequency of 1 kHz to the driving part 31, and projecting the wire 23 having the diameter of 200 μm by approximately 20 pm by the driving part 31 which is used in the wire dot type printer. The tip end part 23A of the wire 23 did not fluctuate, and the velocity of the ejected ink particles 17*a* was 6 m/s and stable.

According to this structure, when replacing the ink cassette 21 having blocked nozzles 24 by a new ink cassette, it is possible to make certain that no positioning error of the tip end part 23A of the wire 23 occurs, because the guide 22 is fixed to the ink cassette 21 side. Hence, the tip end part 23A of the wire is constantly positioned at the predetermined part of the vibration plate 25*a*, and a uniform ejection of the ink particles 17*a* is obtainable by preventing the fluctuation of the tip end part 23A when projecting the wire 23.

The vibration plate 25*a* and the wire guide 22 are in contact in FIG. 24, but a gap may be formed between the vibration plate 25*a* and the wire guide 22 as in the case shown in FIG. 5B.

In each of the above embodiments, the area of the vibration plate (determined by the outer walls of the pressure chamber) must be greater than the tip end area of the wire. It is difficult to improve the density of the nozzles because the vibration plate and the nozzle correspond one to one.

Figure 26:
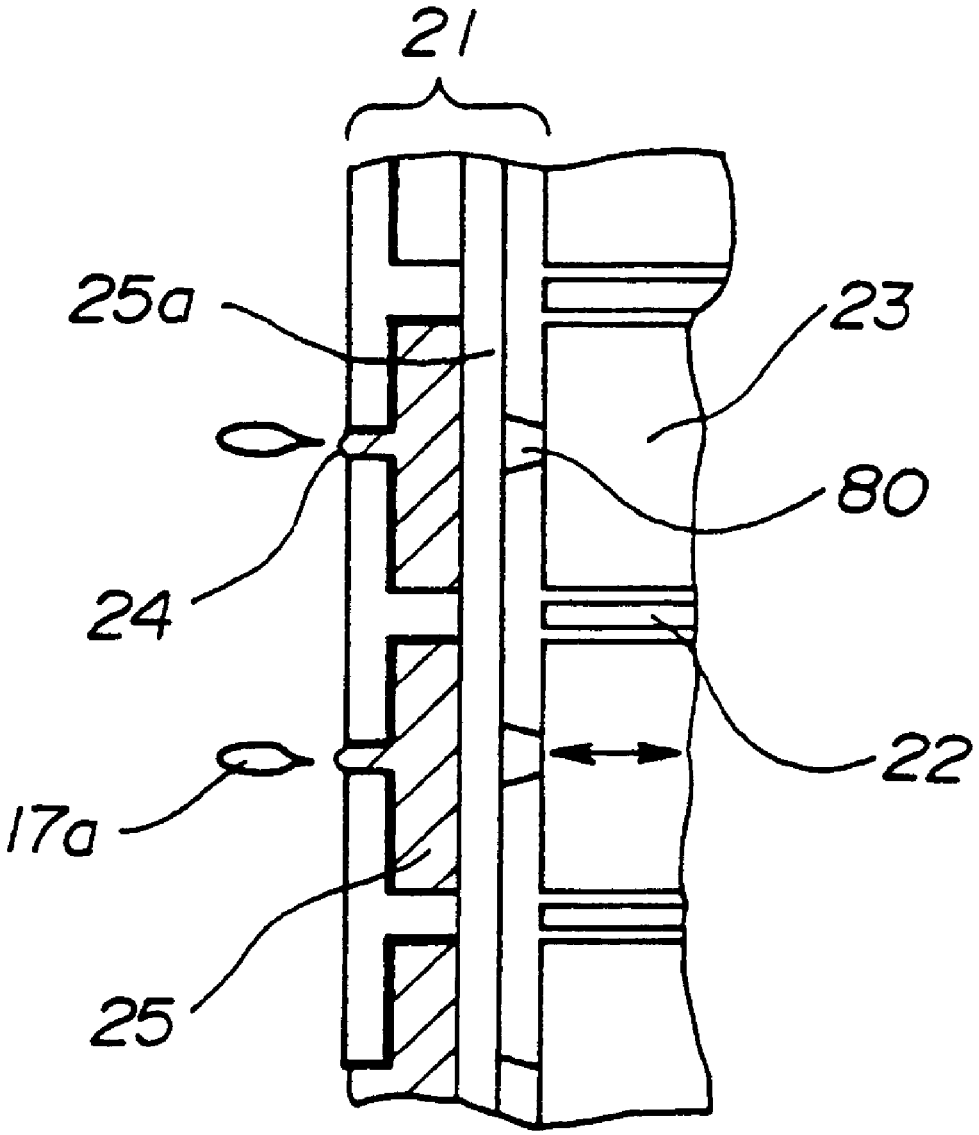
FIG. 26 is a cross sectional view showing an essential part of an eighth embodiment of the printing head according to the present invention.

Next, a description will be given of an embodiment in which the density of the nozzles can be improved. FIG. 26 is a cross sectional view showing an essential part of an eighth embodiment of the printing head according to the present invention. In FIG. 26, those parts which are essentially the same as those corresponding parts in FIG. 5B are designated by the same reference numerals, and a description thereof will be omitted.

In this embodiment, a projection 80 is provided at the central part of the vibration plate 25*a* or the central part of the tip end of the wire 23. When the wire 23 is displaced pressure is applied through, the projection 80 to the central part of the vibration plate 25*a*, and the pressure of the wire 23 always acts at the central part of the vibration plate 25*a*. In addition, it is possible to prevent a hole from being formed in the vibration plate 25*a* due to mechanical frictional wear between the wire 23 and the vibration plate 25*a*. Furthermore, there is no need to make the diameter of the wire 23 smaller than the diameter of the pressure chamber 25.

The material used for the projection 80 is not limited to a particular material. For example, when the projection 80 is formed from the same stainless steel forming the vibration plate 25*a*, the projection 80 may be formed on the vibration plate 25*a* by a known etching technique. On the other hand, when the projection 80 is made of a resilient material, it is possible to take measures against noise as in the fifth embodiment described in conjunction with FIG. 16, in addition to the effects of this embodiment.

In this embodiment, the arrangement pitch of the wires 23 and the arrangement pitch of the nozzles 24 are the same, but the present invention is not limited to such. In addition, a plurality of projections 80 may be provided with respect to one wire 23, i.e., for each wire 23, and the shape of the projection 80 is not limited to the cylindrical shape. Moreover, a depression which engages the projection 80 may be provided on the wire 23.

In each of the above embodiments, the outer wall of the pressure chamber or the vibration plate is made of a single member, i.e., plate. For this reason, a residual vibration is introduced in the vibration plate even after the wire hits the vibration plate, i.e., when not in contact with the vibration plate. There is a possibility that the ink ejection will become unstable due to this residual vibration.

Next, a description will be given of an embodiment in which the residual vibration of the vibration plate can be suppressed.

Figure 27:
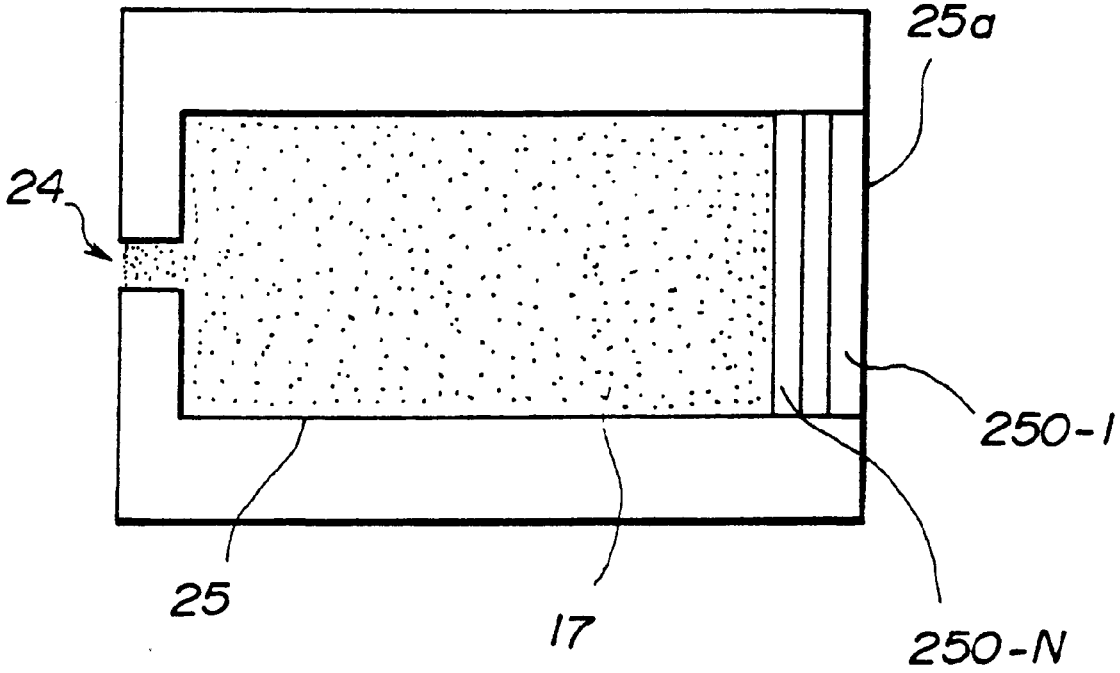
FIG. 27 is a cross sectional view showing an essential part of a ninth embodiment of the printing head according to the present invention.

FIG. 27 shows an essential part of a ninth embodiment of the printing head according to the present invention. In FIG. 27, those parts which are essentially the same as those corresponding parts in FIG. 24 are designated by the same reference numerals, and a description thereof will be omitted. In FIG. 27, the illustration of the wires is omitted.

In this embodiment, a vibration plate 25*a* is made up of plates 250-1 through 250-N. The plates 250-1 through 250-N are respectively made of a material such as stainless steel, glass, silicon and resin. In order to obtain a displacement of the vibration plate 25*a* necessary to inject the ink 17 the appropriate thickness of the plates 250-1 through 250-N is 10 to 500 μm. In this embodiment, the thickness of each plate and the total number of plates are determined so that the total thickness of the stacked plates 250-1 through 250-N is 500 pm or less, in order to suppress the residual vibration of the vibration plate 25*a*.

In addition, in order to suppress the residual vibration of the vibration plate 25*a*, the coefficient of friction among the plates forming the vibration plate 25*a* is optimized. The coefficient of friction among the plates can be set by subjecting each plate to a surface processing. The methods of carrying out the surface processing are a mechanical surface processing method and a method of coating grease, wax or the like between the plates.

Figure 28A:
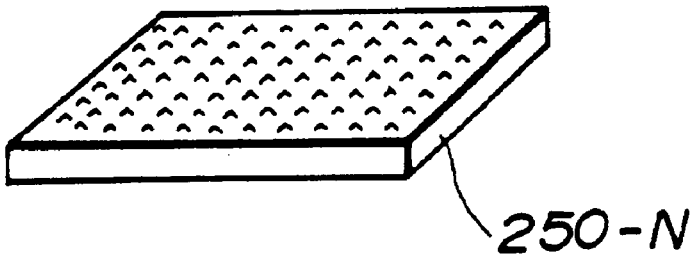
FIGS. 28A through 28C respectively are diagrams for explaining a mechanical surface processing carried out on a plate of a vibration plate.
Figure 28B:
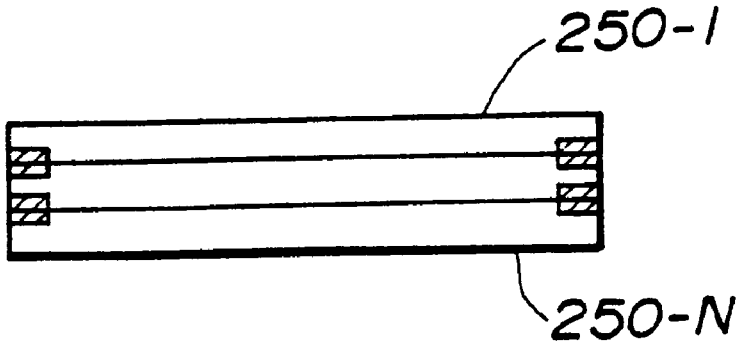
Figure 28C:
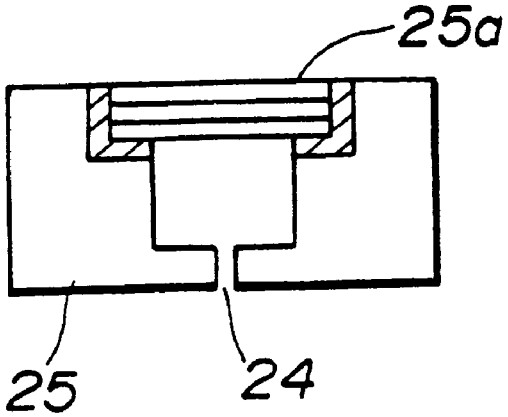

FIGS. 28A through 28C are diagrams for explaining the mechanical surface processing which is carried out on the plates 250-1 through 250-N of the vibration plate 25*a*. First, as shown in FIG. 28A, a known mechanical surface processing is carried out on each of the plates 250-1 through 250-N so as to make at least one surface of each plate rough. Thereafter, the plates 250-1 through 250-N are stacked as shown in FIG. 28B, and the assembly of the vibration plate 25*a* is completed by adhering with liquid adhesive and/or solder at parts indicated by the hatchings. Finally, the vibration plate 25*a* is assembled on the pressure chamber 25 as shown in FIG. 28C and adhered with liquid adhesive and/or solder at parts indicated by the hatchings.

Figure 29A:
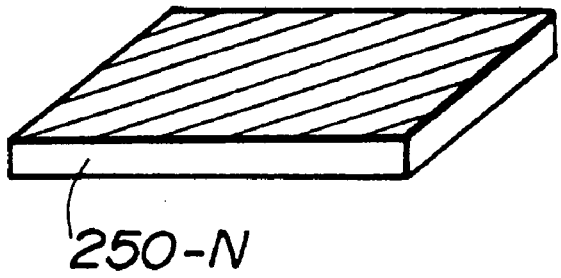
FIGS. 29A through 29C respectively are diagrams for explaining a wax coating made on the plate of the vibration plate.
Figure 29B:
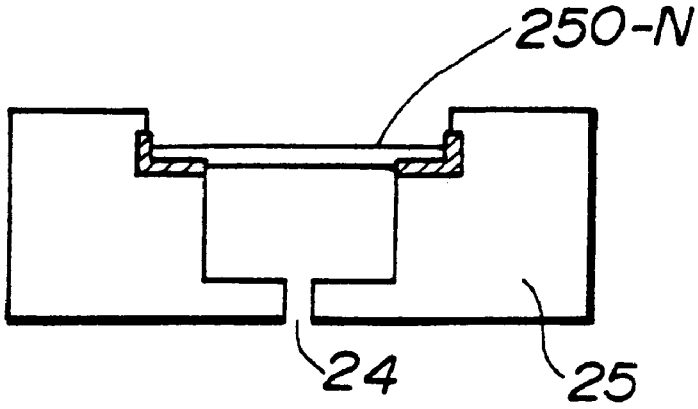
Figure 29C:
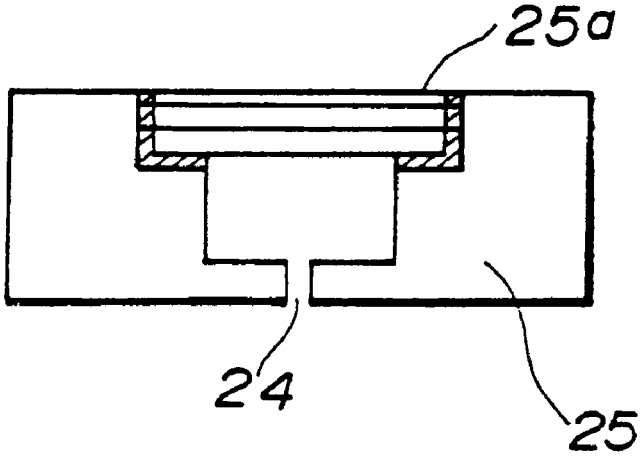

FIGS. 29A through 29C are diagrams for explaining the wax coating which is made on the plates 250-1 through 250-N of the vibration plate 25*a*. First, the wax is coated on at least one surface of each of the plates 250-1 through 250-N as shown in FIG. 29A. Thereafter, the plate 250-N is assembled on the pressure chamber 25 and adhered with liquid adhesive and/or solder at parts indicated by the hatchings in FIG. 29B. Such an assembling process is carried out for the other plates 250-(N-1) through 250-1, so that the vibration plate 25*a* is finally assembled on the pressure chamber 25 as shown in FIG. 29C. In FIG. 29C, the hatchings indicate the parts where the adhesion by a liquid adhesive and/or solder take place.

According to this embodiment, the ink 17 can be ejected stably because the residual vibration of the vibration plate 25*a* can be suppressed.

Figure 30:
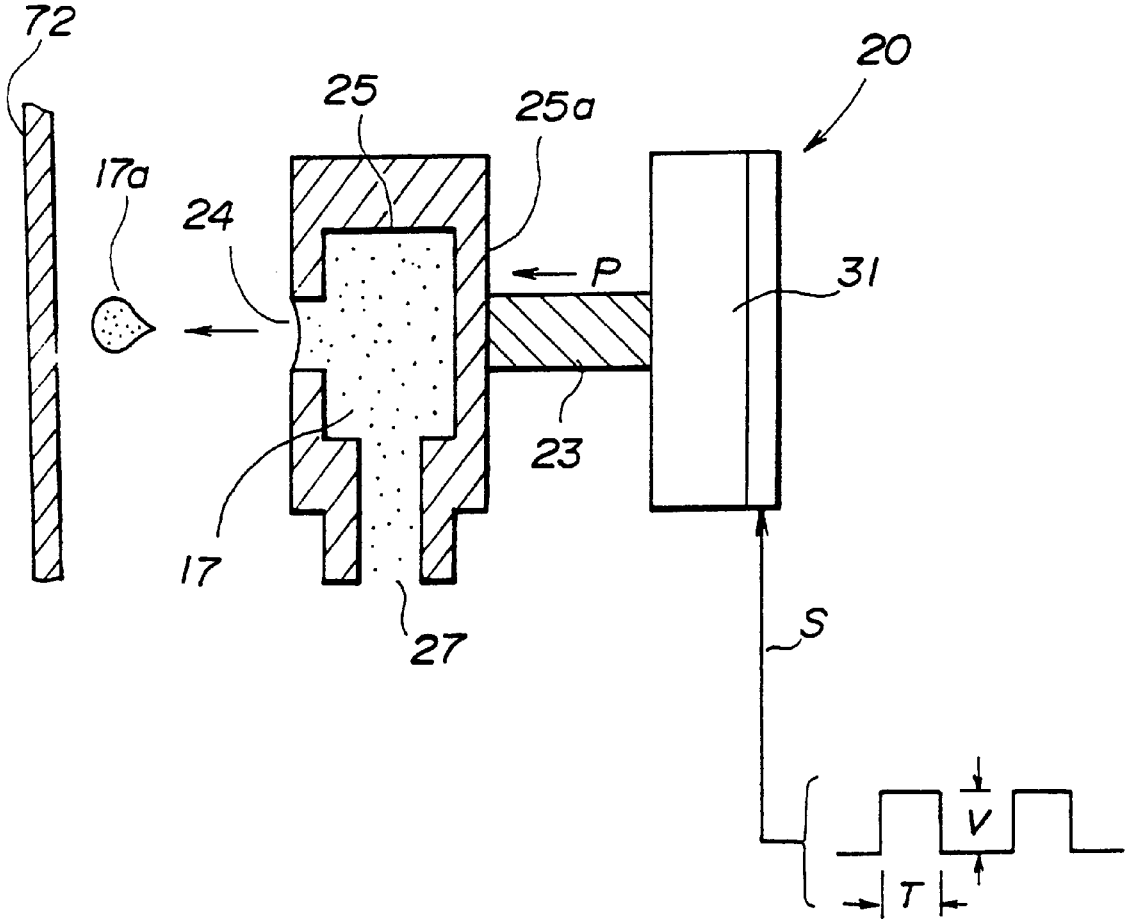
FIG. 30 is a cross sectional view showing an essential part of a tenth embodiment of the printing head according to the present invention.

Next, a description will be given of an embodiment in which gradation recording having contrast is possible. FIG. 30 shows an essential part of a tenth embodiment of the printing head according to the present invention. In FIG. 30, those parts which are the same as those corresponding parts in FIGS. 24 and 25 are designated by the same reference numerals, and a description thereof will be omitted.

In this embodiment, the quantity of the particles 17*a* of the ink 17 ejected from the nozzle 24 is controlled by controlling a pressure P which is applied to the vibration plate 25*a* by the wire 23. The pressure P is controlled by controlling a pulse voltage V of a driving signal S which is supplied to the driving part 31 and/or controlling a pulse width T of the driving signal S.

Figure 31:
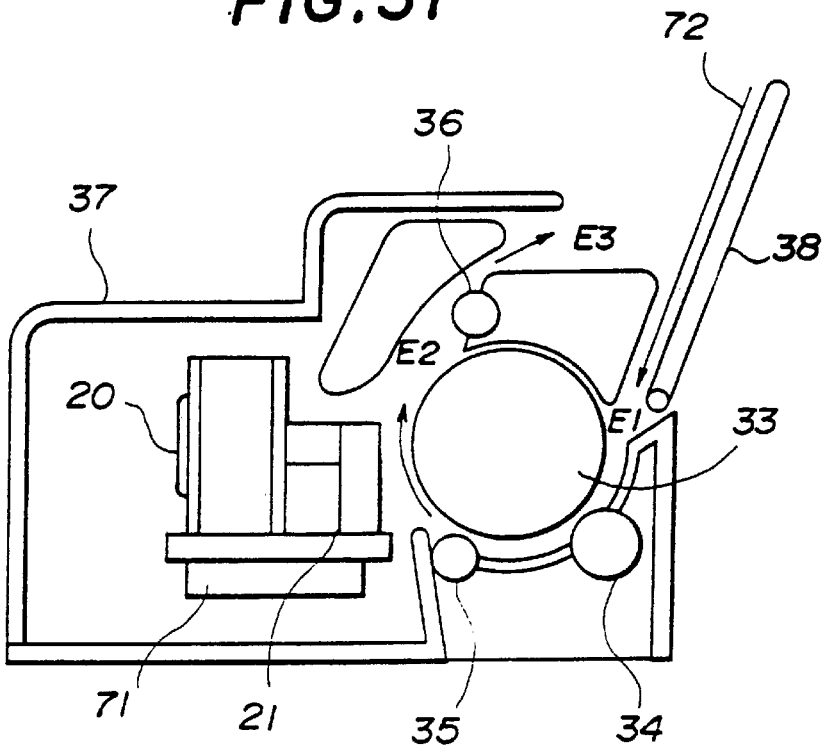
FIG. 31 is a side view showing a printer employing the tenth embodiment.
Figure 32:
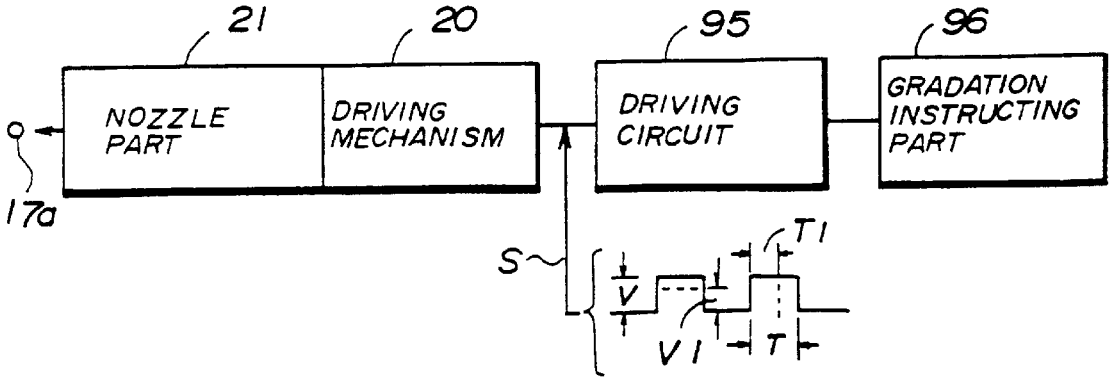
FIG. 32 is a block diagram showing an essential part of the tenth embodiment.
Figure 33:
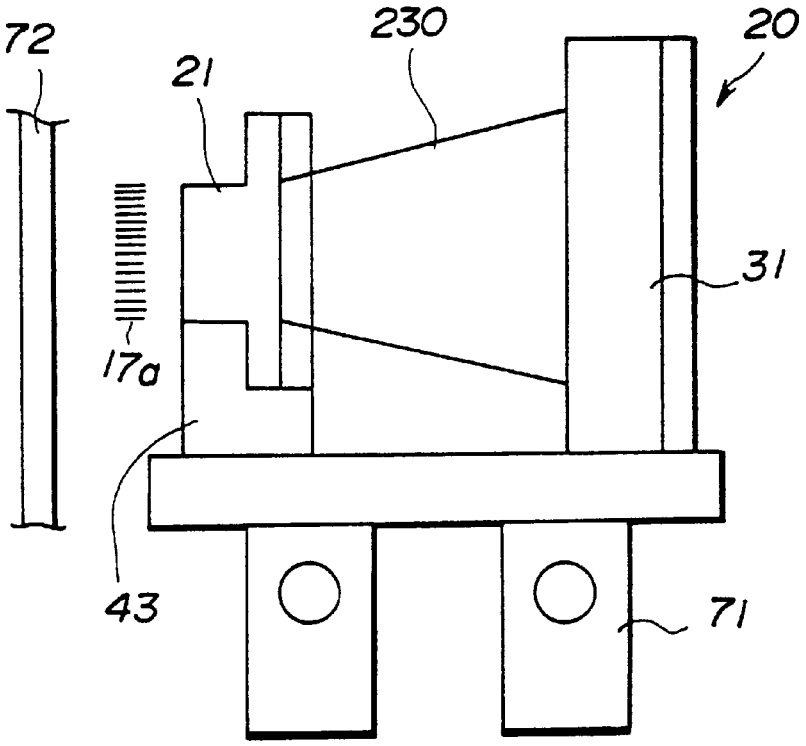
FIG. 33 is a side view showing an essential part of the tenth embodiment.
Figure 34:
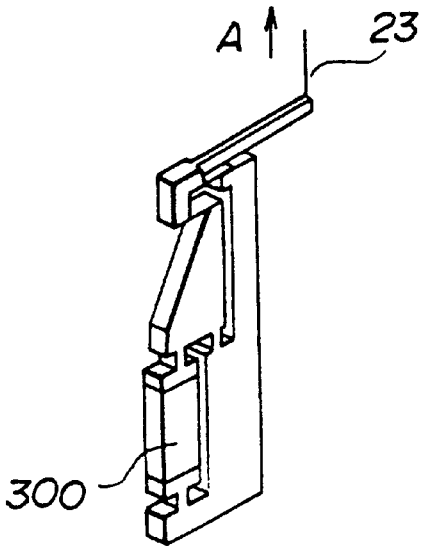
FIG. 34 is a perspective view showing an essential part of a driving mechanism used in the tenth embodiment.

A more detailed description will be given of this embodiment by referring to FIGS. 31 through 34. FIG. 31 is a side view showing a printer employing this embodiment. In FIG. 31, those parts which are the same as those corresponding parts in FIG. 9 are designated by the same reference numerals, and a description thereof will be omitted. FIG. 32 shows a block diagram of this embodiment, and FIG. 33 is a side view of this embodiment. FIG. 34 is a perspective view showing an essential part of a driving mechanism which is used in this embodiment.

As shown in FIG. 31, the ink cassette (nozzle part) 21 and the driving mechanism 20 are mounted on the carriage 71, and the recording paper 72 is fed in direction shown by arrow E1 from a paper guide (stacker) 38 by the guide rollers 34, 35 and 36 which are arranged on the outer periphery of the platen 33. After a predetermined printing is made on the recording paper 72 by the nozzle part 21, the paper is ejected from an ejection opening of a printer cover 37 as indicated by arrows E2 and E3.

In addition, as shown in FIG. 32, the pulse voltage V or the pulse width T of the driving signal S, which is supplied from a driving circuit 95 to the driving mechanism 20, is set to a predetermined value V1 or T1 by an instruction from a gradation instructing part 96. The driving mechanism 20 is driven by a predetermined driving signal S, so that predetermined ink particles 17*a* are ejected from the nozzle part 21.

The nozzle part 21 and the driving mechanism 20, which are mounted on the carriage 71, are arranged as shown in FIG. 33 so that a wire part 230 of the driving mechanism 20 is positioned on the rear surface of the nozzle part 21 and the recording paper 72 is positioned at the front face, i.e., in front of the nozzle part 21. Further, the ink tank 43 for supplying the ink 17 is provided to the nozzle part 21. Accordingly, when the ink 17 stored in the ink tank 43 is consumed, the nozzle part 21 is removed from the carriage 71, and the nozzle 71 can be replaced with ease by mounting a new nozzle part on the carriage 71.

The driving part shown in FIG. 7 may be used as the pressure applying part 31 of the driving mechanism 20. As shown in FIG. 34, it is possible to use a piezoelectric element 300 in place of the electromagnetic attraction part 30. In this case, the wire 23 is connected to one end of the piezoelectric element 300, and the wire 23 is projected in the direction shown by arrow A by driving the piezoelectric element 300.

This embodiment uses the ink 17 which includes a black dye having a surface tension of 52 dyne/cm and a coefficient of viscosity of 4 cp. In this case, when the printing was made using the driving signal S having the voltage V of 100 V and the pulse width T of 100 $\mu$s, an image having a recording density OD of 1.3 was printed on the recording paper 72. When the voltage V was reduced to 40 V, an image having the recording density OD of 0.2 was obtained. In addition, when the pulse width T of the driving signal S was set to 100 $\mu$s, an image having a variable recording density OD of between 0.2 to 1.3 was obtained by varying the voltage V from 40 to 100 V. Similarly, it was confirmed that an image having a variable recording density OD of between 0.2 to 1.3 is also obtained when the voltage V of the driving signal S is set to 100 V and the pulse width T is varied from 50 to 100 $\mu$s.

Accordingly, by setting the voltage V and/or the pulse width T of the driving signal S, which is supplied from the driving circuit 95, to predetermined values depending on the instruction from the gradation instructing part 96 shown in FIG. 32, the mass of the ink particles 17*a* ejected from the nozzle part 21 is controlled and it is possible to print a gradation image having contrast.

In the case of the printing head having a plurality of nozzles, an inconsistent gap on the order of several $\mu$m is formed between each vibration plate and the tip end of the corresponding wire at the stationary position of the wire due to errors and the like introduced during the production stage. However, if the gaps are not all the same, the velocity and quantity of the ink particles ejected from the nozzle become different for each nozzle, and the recording, i.e., printing quality deteriorates.

Figure 35:
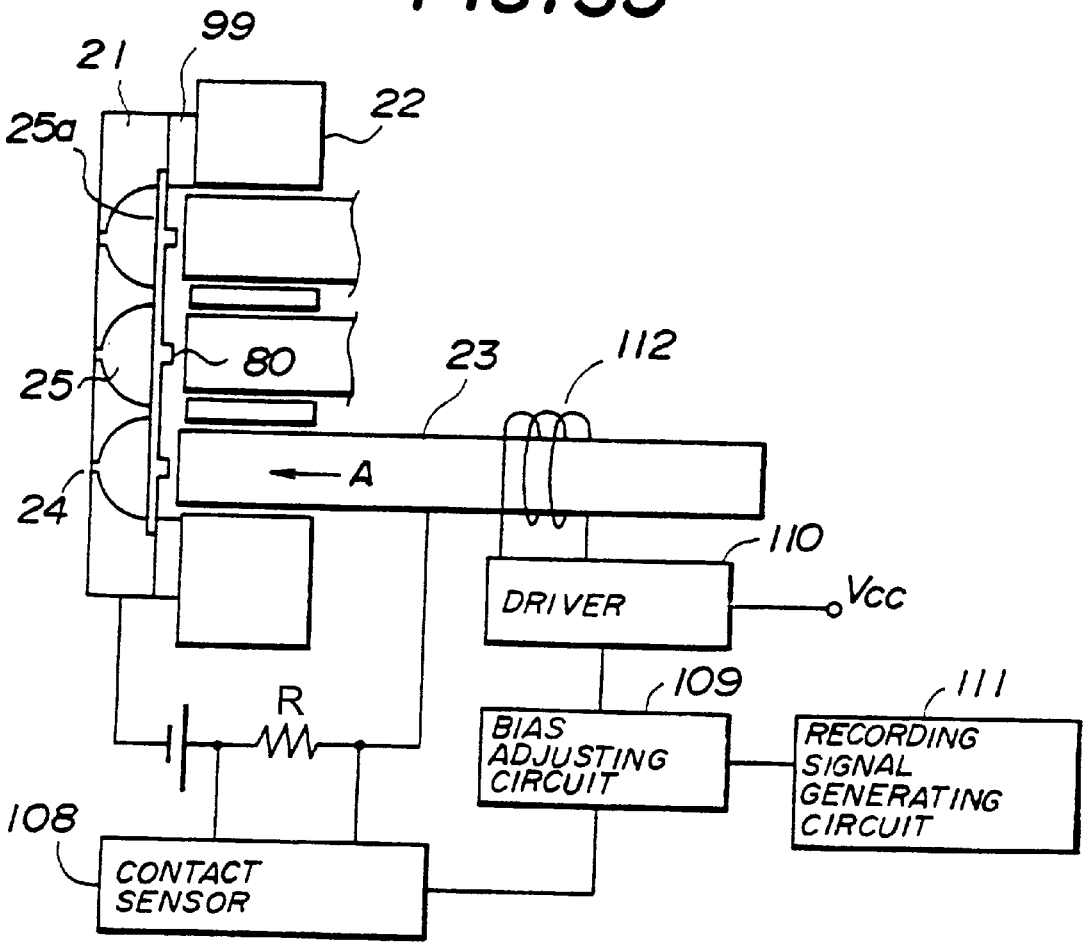
FIG. 35 is a partial cross sectional view showing an essential part of an eleventh embodiment of 5 the printing head according to the present invention.

A description will next be given of an embodiment which can eliminate the above problem. FIG. 35 shows an essential part of an eleventh embodiment of the printing head according to the present invention. In FIG. 35, those parts which are essentially the same as those corresponding parts in FIG. 26 are designated by the same reference numerals, and a description thereof will be omitted.

In this embodiment, a spacer 99 made of an insulator material is provided between the wire guide 22 and the ink cassette (nozzle part) 21. In addition, a contact sensor 108 which detects contact between the wire 23 and the projection 80, i.e., when they are in contact, by detecting a current flowing through a resistor R, a bias adjusting circuit 109, a driver 110 and a recording signal generating circuit 111 are provided. Vcc denotes a power source.

In FIG. 35, when a boost signal is applied to the driver 110 by adjusting a variable resistor within the bias adjusting circuit 109, the variable resistor being adjusted by the recording signal generating circuit ill at the time when the power source is turned ON, the driver 110 applies a voltage to an electromagnetic circuit 112 and the wire 23 gradually moves in the direction shown by arrow A depending on the boost signal. The wire 23, the vibration plate 25*a* and the projection 80 are respectively each made of a conductor. Hence, when the wire 23 makes contact with the projection 80, the contact sensor 108 detects this contact by detecting current flowing through the resistor R. When the contact is detected, the sensor 108 supplies a boost stop signal to the bias adjusting circuit 109 responsive thereto and determines a bias voltage $V_B$. Such an operation is carried out for each wire 23, and the bias voltage $V_B$ is independently determined for each wire 23.

Figure 36:
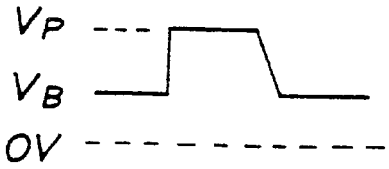
FIG. 36 is a diagram showing a print voltage.

When carrying out the actual printing operation, a print voltage $V_P$ is applied from the driver 110 to the electromagnetic circuit 112 and is a sum of the bias voltage $V_B$ and a recording voltage $V_R$ from the recording signal generating circuit 111. As shown in FIG. 36, when the slope of the trailing edge of the recording voltage $V_R$ is made gradual, it is possible to make the return velocity of the wire 23 more gradual than the residual vibration velocity of the vibration plate 25*a*, and in this case, it is thereby possible to suppress the residual vibration of the vibration plate 25*a*.

Figure 37:
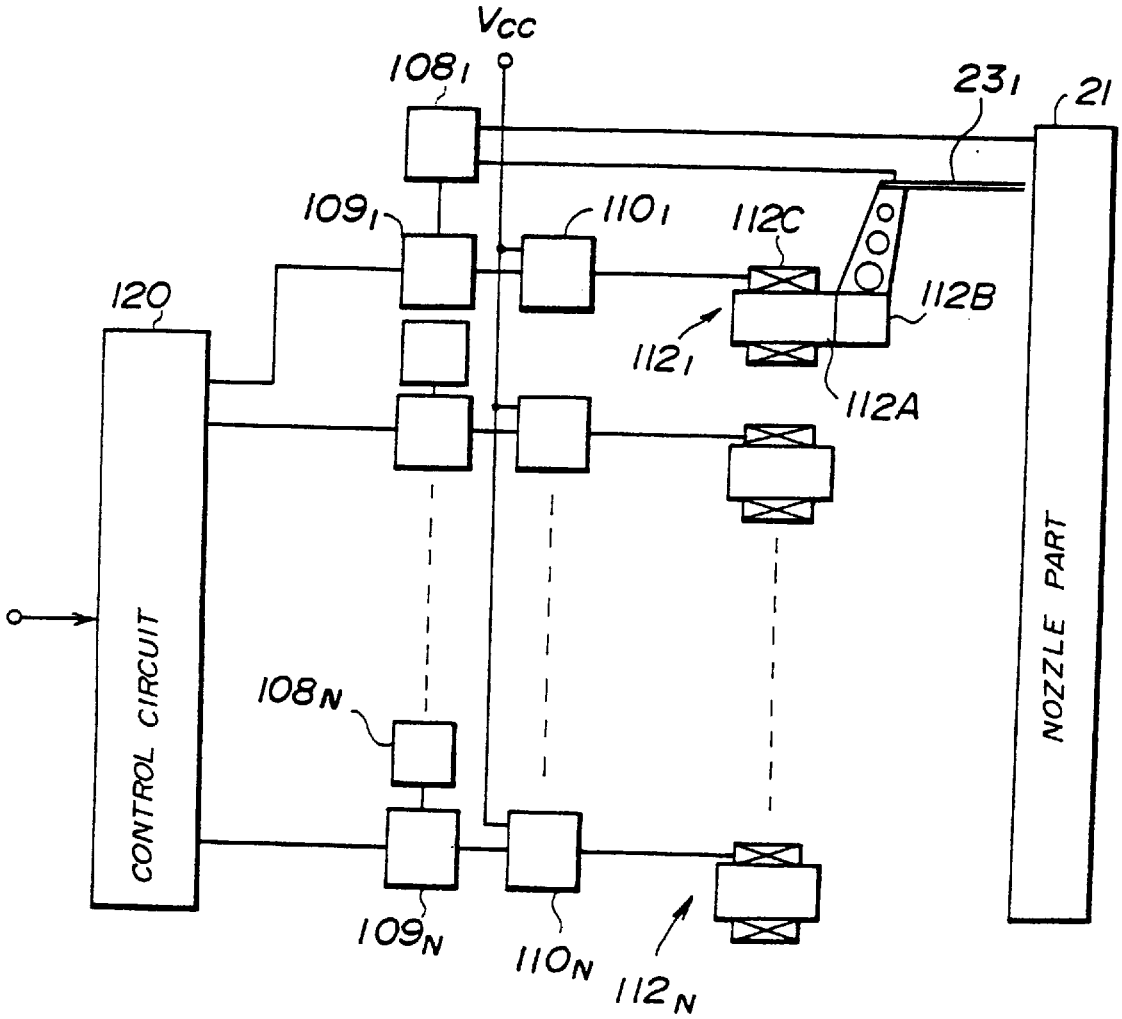
FIG. 37 is a block diagram showing the eleventh embodiment.
Figure 38:
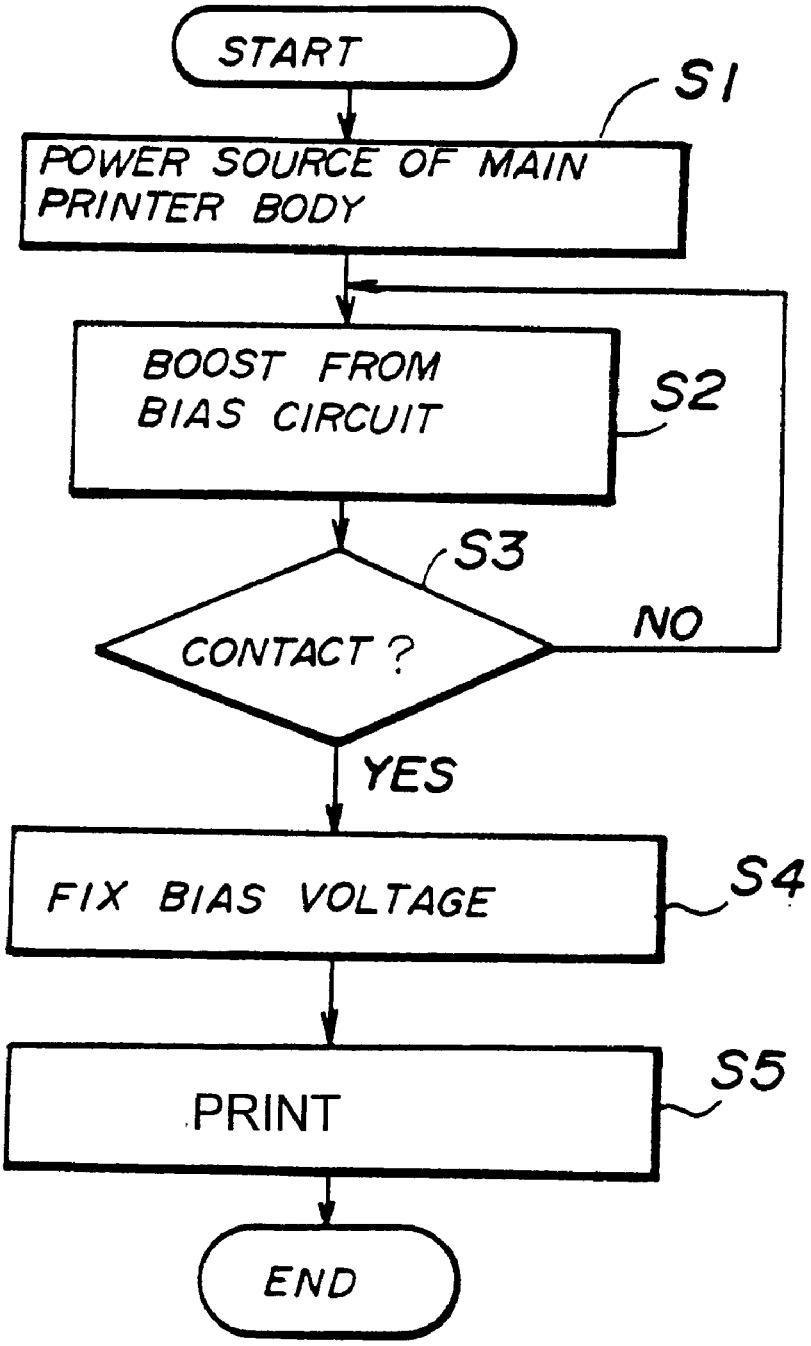
FIG. 38 is a flow chart for explaining the operation of a control circuit shown in FIG. 37.

FIG. 37 shows a block diagram of this embodiment, and FIG. 38 is a flow chart for explaining the operation of a control circuit. In FIG. 37, those parts which are the same as those corresponding parts in FIG. 35 are designated by the same reference numerals, and a description thereof will be omitted.

In FIG. 37, a sensor $\mathbf{108}_i$, a bias adjusting circuit $\mathbf{109}_i$, a driver $\mathbf{110}_i$ and an electromagnetic circuit $\mathbf{112}_i$ are provided with respect to each wire $\mathbf{23}_i$, where i=1, 2, . . . , N. Each electromagnetic circuit $\mathbf{112}_i$ is made up of a core 112A, an armature 112B and a coil 112C. The recording voltage $V_R$ from the recording signal generating circuit 111, is supplied to a control circuit 120, for example.

In FIG. 38, a step S1 turns the power source of the main printer body ON and supplies the power source voltage Vcc to each part of the printer. A step S2 controls the bias circuit $\mathbf{109}_i$ and supplies a boost signal to the driver $\mathbf{110}_i$. A step S3 decides whether or not the sensor $\mathbf{108}_i$ has detected contact between the wire $\mathbf{23}_i$ and the corresponding projection 80. If the decision result, i.e., answer is YES, a step S4 fixes the bias voltage $V_B$ which is output from the bias adjusting circuit $\mathbf{109}_i$. The steps S2 through S4 are carried out with respect to each of the wires $\mathbf{23}_i$ through $\mathbf{23}_N$. Thereafter, a step S5 carries out the actual printing.

It is possible to store each bias voltage $V_B$ in a memory (not shown) within the control circuit 120 or an externally coupled memory (not shown).

According to this embodiment, the bias voltage is supplied to the driving part so that the pressure of each wire with respect to the vibration plate becomes constant. Hence, the velocity and quantity of the ink particles ejected from the nozzle become constant, and it becomes possible to carry out a high quality printing. In addition, since the wire is always in contact with the corresponding vibration plate, it is possible to suppress the residual vibration of the vibration plate and enable a high-speed printing. It is also possible to prevent the noise generated upon contact between the wire and the vibration plate.

In each of the above embodiments, the printing cannot be used for making slips and other pressure actuated duplicates because they employ ink jet technology. However, it is possible to make duplicates using the printing head of the wire dot type printer. Because each embodiment can use the wire magnetic drive type driving mechanism as described above, it would be very convenient, if it were possible, to selectively switch the printing system between the ink jet system and the impact system, and it would be possible to make duplicates.

Next, a description will be given of an embodiment which satisfies the above demand.

Figure 39A:
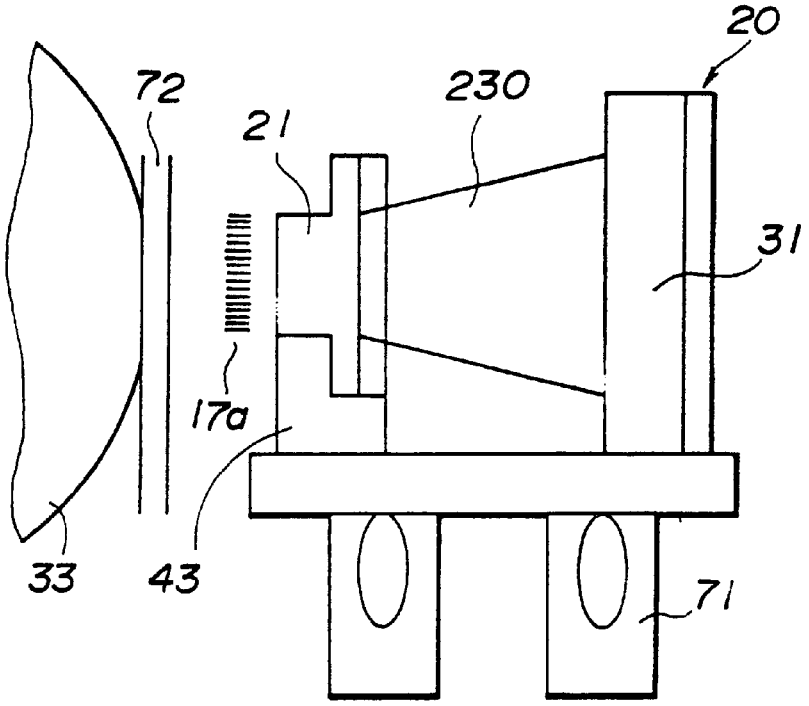
FIGS. 39A and 39B respectively are side views showing a twelfth embodiment of the printing head according to the present invention.
Figure 39B:
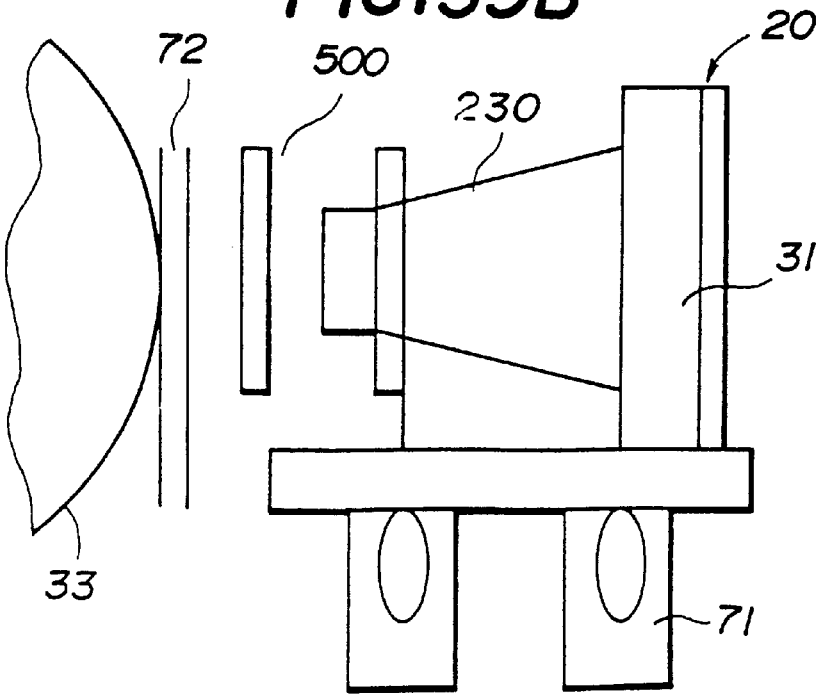

FIGS. 39A and 39B respectively show an essential part of a twelfth embodiment of the printing head according to the present invention. In FIGS. 39A and 39B, those parts which are the same as those corresponding parts in FIGS. 31 and 33 are designated by the same reference numerals, and a description thereof will be omitted. FIG. 39A shows the case where the ink jet system is used, and FIG. 39B shows the case where the impact system is used.

In FIG. 39A, the nozzle part 21 is mounted on the printing head. The operation of this printing head is the same as the printing head shown in FIG. 33. In this embodiment, the diameter of the nozzle is 500 $\mu$m, the length of the nozzle is 200 $\mu$m, the diameter of the pressure chamber is 500 $\mu$m, the length of the pressure chamber is 100 $\mu$m, the thickness of the stainless steel vibration plate is 50 $\mu$m, and the diameter of the wire is 200 $\mu$m. The piezoelectric drive type mechanism shown in FIG. 34 was used as the driving mechanism 20. An ink including a black dye with a surface tension of 52 dyne/cm and a coefficient of viscosity of 4 cp was used for the ink. A satisfactory printing was possible under these conditions when the driving voltage of 20 V and a driving frequency of 3 kHz was applied to the driving part 31. The displacement of the wire was on the order of 20 $\mu$m, and the velocity of the ink particles 17*a* was 6 m/s.

In FIG. 39B, the nozzle 21 is removed from the printing head, and an ink ribbon 500 is arranged between the tip end of the wire and the recording paper 72. The ink ribbon 500 is accommodated within an ink ribbon cartridge (not shown), and the ink ribbon cartridge is loaded with respect to the printing head. In this case, when the driving voltage of 100 V was applied to the driving part 31, it was confirmed that a satisfactory duplicate is obtainable even if the printing is carried out using carbon paper as the recording paper 72.

The driving, i.e., operating conditions of the driving part between the case where the ink jet system is used and the case where the impact system is used, may be switched manually or automatically. When switching the driving conditions automatically, it is sufficient to detect the loading of the nozzle part 21 or the ink ribbon cartridge by a sensor (not shown) or the like.

Figure 40:
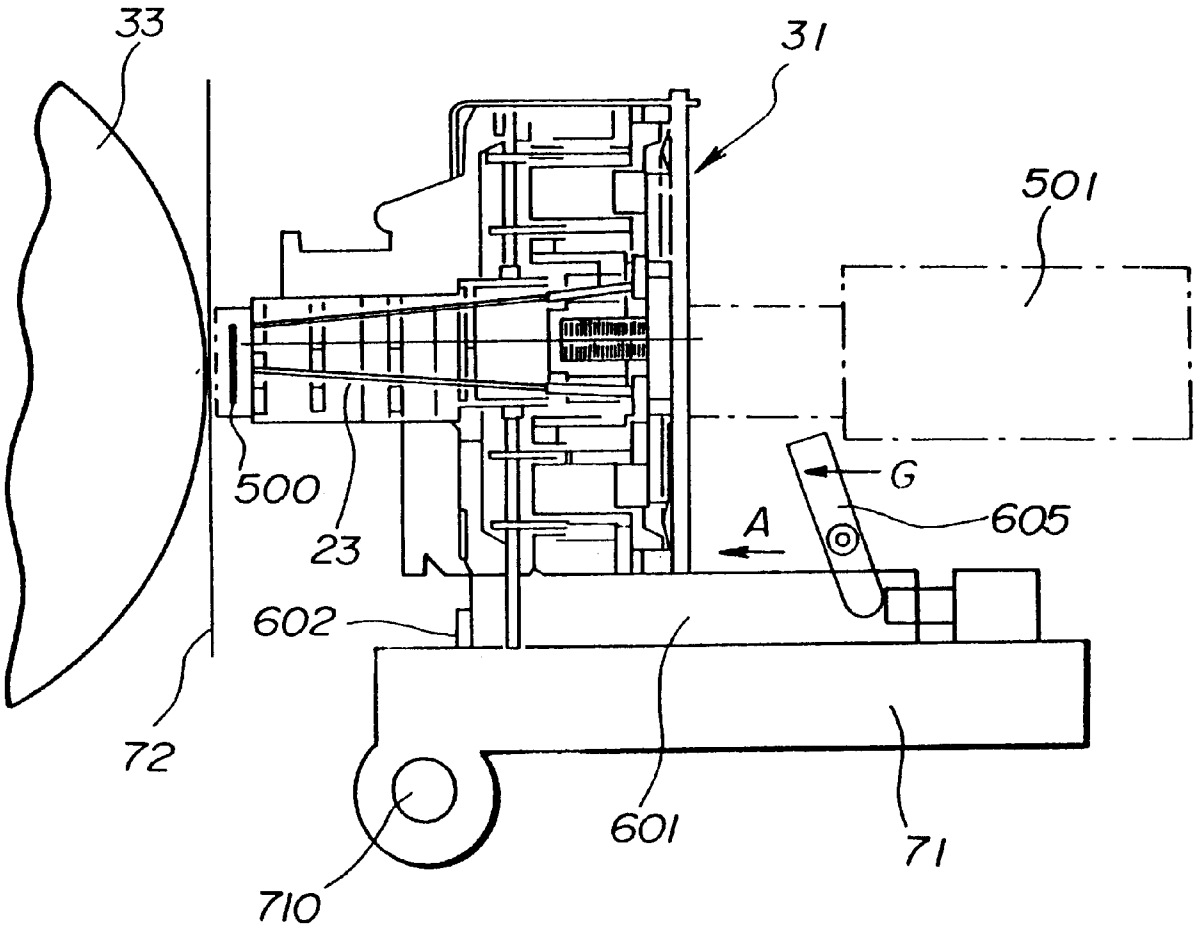
FIG. 40 is a partial cross sectional view for explaining the operation of the twelfth embodiment.

The displacement of the wire when carrying out the printing using the impact system is 200 $\mu$m, for example. However, because the nozzle part 21 is removed, it is necessary to move the printing head closer towards the platen 33. FIG. 40 shows a mechanism for moving the printing head in the direction shown by arrow A in this embodiment. In FIG. 40, a one-dot chain line indicates an ink ribbon cartridge 501 which accommodates the ink ribbon 500.

In FIG. 40, the printing head is provided on the carriage via a movable stage 601. The carriage 71 is movable along a guide 710 in the longitudinal direction of the platen 33. When carrying out the printing using the impact system, a lever 605 is turned in a direction shown by arrow G so as to move the movable stage 601 in the direction shown by arrow A up to a position where it is stopped by a stopper 602.

The printing head according to the present invention can of course be applied to color printing. In addition, the information which is printed is not limited to characters and may be various kinds of images. In addition, it is possible to freely combine a plurality of the embodiments described above.

Further, the present invention is not limited to these embodiments, but various variations and modifications may be made without departing from the scope of the present invention.

As described above, according to the printing head of the present invention, the vibration plate of the pressure chamber is pushed by the tip end of the wire, and thus, it is possible to carry out the printing satisfactorily. In addition, the driving part side and the pressure chamber side may take the separable structure, i.e., be separable. Therefore, the present invention is extremely useful.

What is claimed is:

1. An ink jet printing head comprising:

a pressure chamber supplied with ink, said pressure chamber having a vibration plate which is subject to being driven in vibration thereby to increase pressure in said pressure chamber when force is applied to said vibration plate, said vibration plate having a first surface and a second surface which is opposite to the first surface;

a nozzle which communicates with said pressure chamber and through which the ink is ejected when the pressure in said pressure chamber is increased;

force applying means for applying force to the first surface of said vibration plate thereby to drive the vibration plate in vibration and thereby increase the pressure in the pressure chamber so as to eject the ink from said nozzle; and support means, arranged at a position excluding a central portion of said pressure chamber, for resiliently supporting the second surface of said vibration plate with respect to said pressure chamber, so as to facilitate displacement of the vibration plate relative to the pressure chamber responsive to the force applied from the force applying means due to resilient deformation of said support means.

2. An ink jet printing head according to claim 1, wherein only one nozzle is in communication with said pressure chamber.

3. The ink jet printing head as claimed in claim 1, wherein:

said support means comprises a resilient member which resiliently supports said vibration plate, so that a displacement of said vibration plate is facilitated when said force applying means applies force to said vibration plate.

4. The ink jet printing head as claimed in claim 3, wherein:

said pressure chamber has a non-vibrating part; and said resilient member is interposed between said vibration plate and said non-vibrating part of said pressure chamber.

5. The ink jet printing head as claimed in claim 3, wherein:

said resilient member supports a peripheral portion of said vibration plate; and said force applying means applies the force at a central portion of said vibration plate.

6. The ink jet printing head as claimed in claim 3, wherein said resilient member is made of a material selected from the group consisting of natural rubbers and synthetic rubbers.

7. The ink jet printing head as claimed in claim 6, wherein said synthetic rubbers are selected from the group consisting of styrene butadiene rubber, butadiene rubber, blown rubber, acrylic rubber, silicone rubber and urethane rubber.

8. The ink jet printing head as claimed in claim 3, wherein said resilient member is made of a resin material.

9. The ink jet printing head as claimed in claim 3, wherein said resilient member is bonded to at least one of said vibration plate and a non-vibrating portion of said pressure chamber by an adhesive agent.

10. The ink jet printing head as claimed in claim 3, wherein said resilient member is made of a material having both resilient and thermal adhesive characteristics.

11. The ink jet printing head as claimed in claim 3, wherein said resilient member is made of a film.

12. The ink jet printing head as claimed in claim 3, wherein said resilient member is made of a material having a resiliency in a range of $0.01\times10^7$ to $0.5\times10^7$ N/m$^2$.

13. The ink jet printing head as claimed in claim 3, wherein said resilient member has a thickness in a range of 10 to 200 $\mu$m.

14. An ink jet printing head comprising:

a pressure chamber supplied with ink;

a vibration plate coupled to said pressure chamber and subject to being driven in vibration thereby to increase pressure in said pressure chamber when force is applied to said vibration plate;

a nozzle which communicates with said pressure chamber and through which the ink is ejected when the pressure in said pressure chamber is increased;

force applying means for applying force to said vibration plate to drive the vibration plate in vibration and thereby increase the pressure in the pressure chamber so as to eject the ink from said nozzle; and a resilient member, interposed between said pressure chamber and said vibration plate and arranged at a position excluding a central portion of said pressure chamber, resiliently supporting the vibration plate relative to said pressure chamber, so as to facilitate displacement of the vibration plate relative to the pressure chamber responsive to the force applied from the force applying means due to resilient deformation of said resilient member.

15. An ink jet printing head according to claim 14, wherein only a single nozzle communicates with said pressure chamber.

16. An ink jet printing head comprising:

a pressure chamber supplied with ink;

a vibration plate coupled to said pressure chamber and subject to being driven in vibration thereby to increase pressure in said pressure chamber when force is applied to said vibration plate;

a nozzle which communicates with said pressure chamber and through which the ink is ejected when the pressure in said pressure chamber is increased;

force applying means for applying force to said vibration plate to drive the vibration plate in vibration and thereby increase the pressure in the pressure chamber so as to eject the ink from said nozzle; and a resilient member, interposed between said pressure chamber and said vibration plate and arranged only at a periphery of the vibration plate, resiliently supporting the vibration plate relative to said pressure chamber and facilitate displacement of the vibration plate relative to the pressure chamber responsive to the force applied from the force applying means due to resilient deformation of said resilient member.

* * * * *

UNITED STATES PATENT AND TRADEMARK OFFICE

CERTIFICATE OF CORRECTION

PATENT NO.: 6,132,035
DATED : October 17, 2000
INVENTOR(S): Michinori KUTAMI et al.

It is certified that error appears in the above-identified patent and that said Letters Patent is hereby corrected as shown below:

On the title page, [56] References Cited, FOREIGN PATENT DOCUMENTS, please add the following reference:

1-115635 05/1989 Japan

Signed and Sealed this

Eighth Day of May, 2001

*Attest:*

Nicholas P. Godici

NICHOLAS P. GODICI

*Attesting Officer*

*Acting Director of the United States Patent and Trademark Office*